US006837840B2

(12) United States Patent
Yonekawa et al.

(10) Patent No.: US 6,837,840 B2
(45) Date of Patent: Jan. 4, 2005

(54) SHEET PROCESSING APPARATUS AND IMAGE FORMING APPARATUS EQUIPPED WITH THE SAME

(75) Inventors: Ken Yonekawa, Mitsukaido (JP); Satoshi Iwama, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 102 days.

(21) Appl. No.: 10/058,054

(22) Filed: Jan. 29, 2002

(65) Prior Publication Data

US 2002/0101020 A1 Aug. 1, 2002

(30) Foreign Application Priority Data

Jan. 30, 2001 (JP) ..... 2001-021662

(51) Int. Cl.[7] ..... B31F 1/10

(52) U.S. Cl. ..... 493/444; 493/254; 493/416; 493/424; 493/449

(58) Field of Search ..... 493/254, 444, 493/437, 405, 416, 424, 442, 449

(56) References Cited

U.S. PATENT DOCUMENTS 411,151 A * 9/1889 Kneeland ..... 493/445
1,501,774 A * 7/1924 Heeter et al.
1,693,147 A * 11/1928 King ..... 270/45
3,576,051 A * 4/1971 Click et al. ..... 425/72.1
4,717,375 A * 1/1988 Lundmark ..... 493/360
5,007,891 A * 4/1991 von Hein ..... 493/444
5,169,376 A * 12/1992 Ries et al. ..... 493/445
6,022,011 A * 2/2000 Hirose ..... 270/37
6,568,668 B1 * 5/2003 Wakabayashi et al. ... 270/58.11

* cited by examiner

*Primary Examiner*—Eugene Kim
*Assistant Examiner*—Chris Harmon
(74) *Attorney, Agent, or Firm*—Manabu Kanesaka

(57) ABSTRACT

A sheet processing apparatus for folding a sheet bundle at a predetermined position includes paired rotating bodies for folding the sheet bundle having nip portions, a pressing device for pressing the predetermined position of the sheet bundle into the nip portions of the paired rotating bodies, and a device connected to the paired rotation bodies for providing rotation to the paired rotating bodies. A pulling force of the rotating bodies to pull the sheet bundle pressed into the nip portions of the rotating bodies has an amount which does not separate a sheet of the sheet bundle contacting the rotating bodies from the subsequent sheets in the sheet bundle when pulling the sheet bundle.

5 Claims, 30 Drawing Sheets

SHEET PROCESSING APPARATUS AND IMAGE FORMING APPARATUS EQUIPPED WITH THE SAME

BACKGROUND OF THE INVENTION AND RELATED ART STATEMENT

The present invention relates to a sheet processing apparatus and an image reading apparatus provided with the same. In particular, it relates to a sheet bundle folding process.

Conventionally, image forming apparatuses, such as copiers, printers, facsimile machines and other devices using a combination of these machines, are equipped with a sheet processing apparatus that stacks sheets discharged from the image forming apparatus and that folds sheet bundles that have been stacked.

As a sheet processing apparatus that folds such sheet bundle, a folding type that employs a folding blade to press the sheet bundle between opposing and paired folding rollers, and then to draw the sheet bundle inward by rotating these folding rollers thereby folding the sheet bundle, is well known in the art.

In the conventional sheet processing apparatus that folds the sheets in this way, pass-through rollers that cover the entire width direction of the sheets are used, and the folding rollers are made of rubber or a material having a comparatively high coefficient of friction.

However, when the folding rollers having this kind of structure are used, in the sheets comprising the sheet bundle Sa, only a sheet Si which directly contacts the folding rollers 257*a* and 257*b* is pulled between the folding rollers forcefully and suddenly by the folding rollers 257*a* and 257*b* comprising a high friction coefficient, thereby causing a gap to be formed between the adjacent sheets. This situation is clearly shown in FIG. 30.

When such a gap is formed, discrepancies in the fold occur in the sheet bundle that passes through these folding rollers. To prevent such problems, the rotating speed thereof can be slowed. However, this results in a slowdown in the overall folding speed.

In view of the problems of the current technology, an object of the invention is to provide a sheet processing apparatus and an image reading apparatus equipped with the same that properly folds sheet bundle without a decrease in the folding speed.

Further objects and advantages of the invention will be apparent from the following description of the invention.

SUMMARY OF THE INVENTION

According to the present invention, a sheet processing apparatus for folding a sheet bundle at a predetermined position comprises paired rotating bodies for folding the aforementioned sheet bundles, and pressing means for pressing the aforementioned predetermined position of the sheet bundle to the nip of the paired rotating bodies. An important characteristic of this invention is that the force to pull the sheet bundle into the nip of the paired rotating bodies by the paired rotating bodies does not separate the sheet in contact therewith from the other sheets of the sheet bundle when the sheet bundle is pulled therebetween.

Another characteristic of the instant invention is that it is configured that the coefficient of friction of the surface of at least one of the paired rotating bodies is reduced so that the pulling force has an amount that does not cause the sheet contacting the paired rotating member to separate from the other sheets.

Still further, a characteristic of the present invention is that the surface along the rotating shaft direction of the at least one of the paired rotating bodies has a region that has a high coefficient of friction and has a region that has a low coefficient of friction.

According to the invention, the region of the high coefficient of friction on the one rotating member is narrower than the region of the high coefficient of friction on the other rotating member of the paired rotating bodies.

Still another characteristic of the instant invention is that one of the paired rotating bodies is positioned lower than the other rotating member.

Still yet another characteristic is that the present invention provides the sheet processing apparatus to an image forming apparatus equipped with an image forming unit and a sheet processing apparatus for folding the sheet bundle formed with images thereupon by the image forming unit at a determined position.

This invention uses pressing means to press a predetermined position of the sheet bundle into the nip of paired rotating bodies thereby folding the sheet bundle at the predetermined position. Furthermore, the force to pull the sheet bundle that is pressed into the nip of the paired rotating bodies has an amount that does not cause the sheet contacting the paired rotating bodies to separate from the other sheets when the sheet bundle is pulled therein, so that there is no forceful or sudden pulling on only the sheet directly in contact with the paired rotating bodies.

DETAILED DESCRIPTION OF PREFERRED EMBODIMENTS

The following describes in detail embodiments according to the present invention in reference to the drawings.

Figure 1:
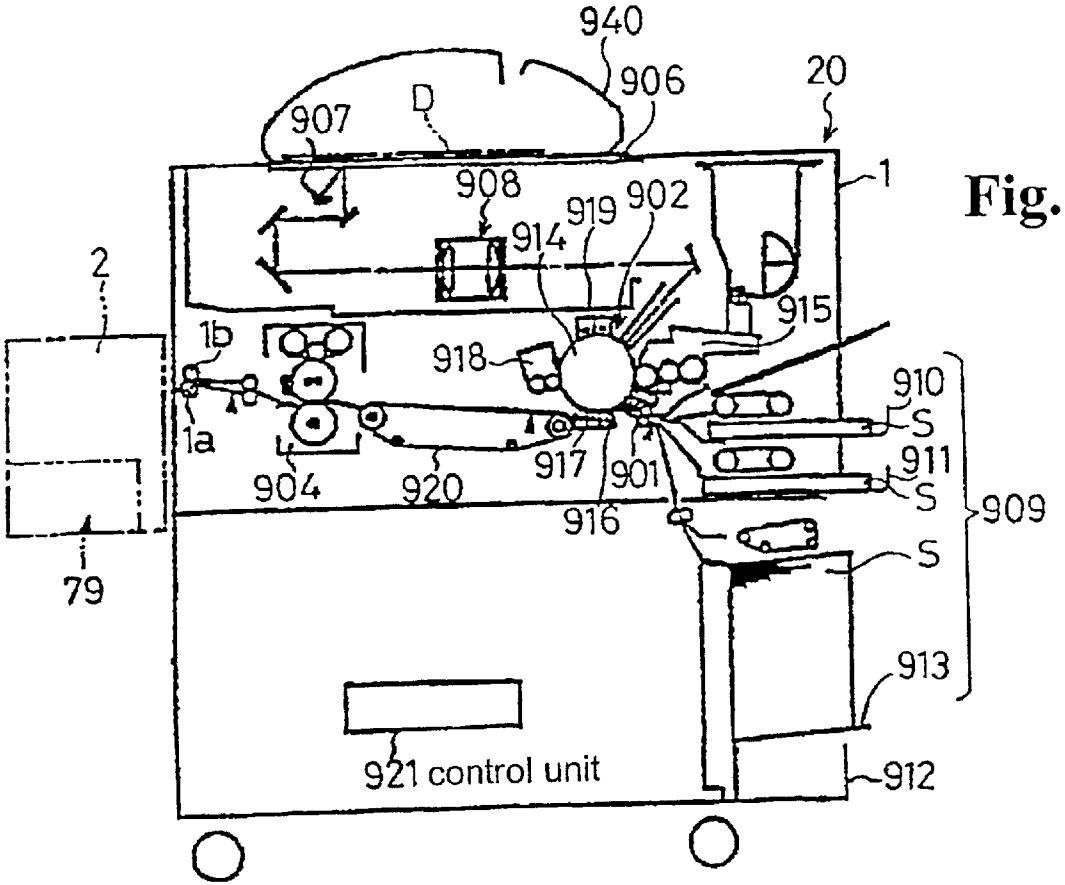
FIG. 1 shows a brief construction for a copier that is an embodiment of the image forming apparatus having the sheet post-processing apparatus equipped therein.

FIG. 1 shows the general structure of a copier which is an example of the image forming apparatus equipped with the sheet processing apparatus according to the embodiment of the present invention.

In the drawing, a main body 1 of a copier 20 comprises a platen glass 906 used as an original table, a light source 907, a lens system 908, a sheet feeder 909, and an image forming section 902. The main body 1 is equipped with an automatic document feeder 940 thereon for automatically feeding an original D to a platen glass 906. Also, a sheet processing apparatus 2 is mounted on the main body 1.

The sheet feeder 909 comprises cassettes 910 and 911 for storing copy sheets S and is detachably mounted to the main body 1 and a deck 913 arranged on a pedestal 912. The image forming section (image forming means) 902 has a cylindrical photoconductor drum 914 and has a developer 915, a separation charger 917, a cleaner 918, and a primary charger 919, that are arranged around the photoconductor drum 914. Downstream of the image forming section 902, there are arranged a feeding apparatus 920, a fixing device 904, and paired discharge rollers la and lb.

The following describes operations of the mechanisms inside the main body 1 of the copier 20. When the paper feed signal is output from a control unit 921 disposed in the main body 1, the sheet S is fed out of the cassettes 910 and 911, or the deck 913. The light source 907 generates light to the document D located on the platen glass 906. That light is reflected by the document D and irradiated through the lens system 908 to the photo-conductor drum 914.

A photo-conductor drum 914 is charged in advance by the primary charger 919 and has an electrostatic latent image formed thereon by the light irradiated thereto. In turn, the photoconductor drum 914 has an electrostatic latent image developed to form a toner image by a developer 915. The sheet S fed from the sheet feeder 909 is skew-corrected and timing-adjusted by a register roller 901 before it is fed to the image forming section 902.

In the image forming unit 902, the toner image on the photo-conductor drum 914 is transferred to the sheet S fed in. After that, the sheet S having the toner image transferred thereto is charged to a polarity reverse to the transfer electrode 916 by a separating charger 917 before being separated from the photo-conductor drum 914.

The separated sheet S is transported to the fixing unit 904 by the feeding apparatus 920. The fixing unit 904 permanently fixes the transferred image onto the sheet S. Furthermore, after forming the image, the sheet S is discharged to the sheet processing apparatus 2 from the main body 1 by the paired discharged rollers 1*a* and 1*b*.

Figure 2:
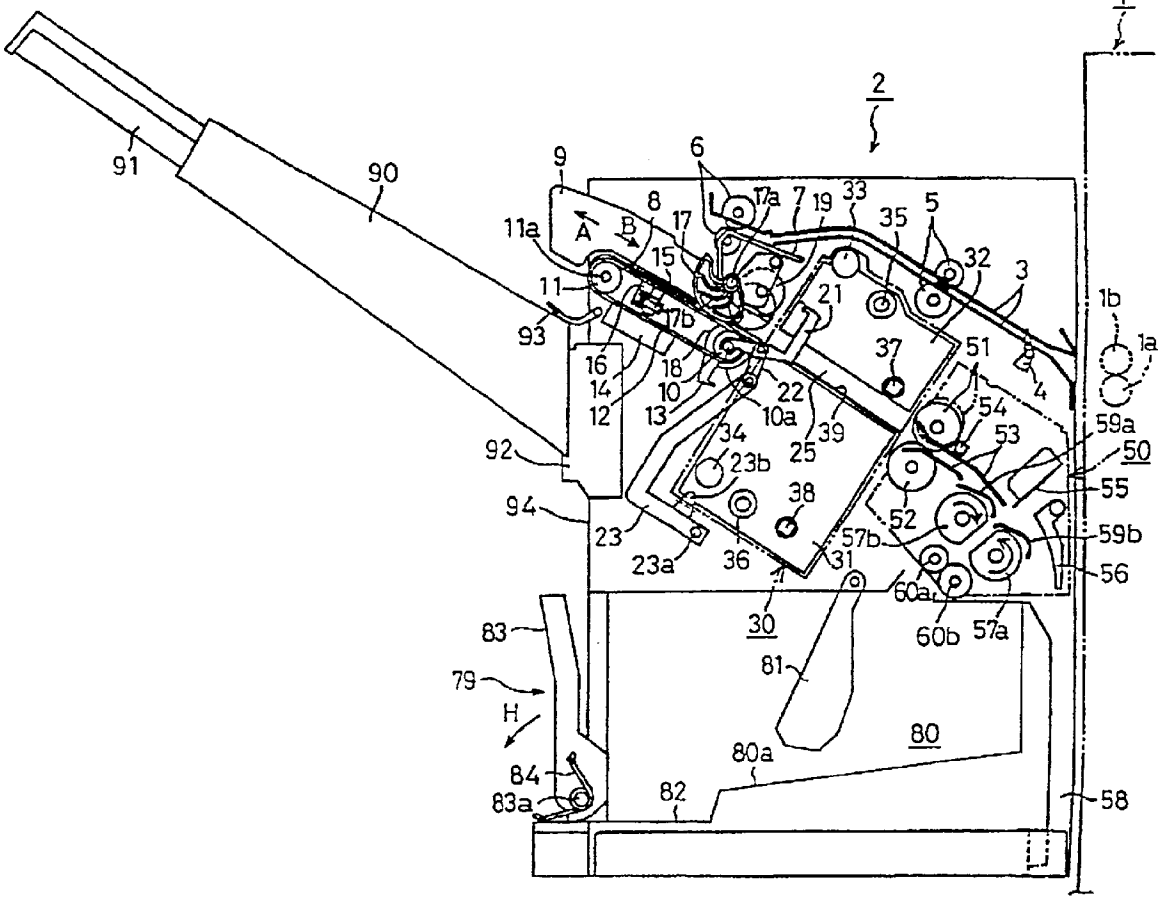
FIG. 2 is a side cross-section view for a structure of the sheet post-processing apparatus.

FIG. 2 is a side cross-section view for the sheet postprocessing apparatus 2. The sheet post-processing apparatus 2, as shown in the Figure, is formed of paired feed guides 3, a sheet detecting sensor 4, a processing tray 8, a saddle stitching unit 30, and a folding unit 50. The paired feed guides 3 receive the sheet discharged from the paired discharge rollers 1*a* and 1*b* and guide the sheet into the sheet post-processing apparatus 2. The sheet detecting sensor 4 operates to detect the sheet fed in the paired feed guides 3.

Detecting the sheet by the sheet detecting sensor 4 serves to determine the timing for alignment and to provide a signal whether or not the sheet has jammed inside the feed guide 3. The paired discharge rollers 6 rotate to support the sheet in the feed guide 3 sandwiched therebetween to feed it.

The processing tray 8 receives and stacks sheets discharged one at a time by the paired discharge rollers. The paired aligning plates 9 are disposed on the processing tray 8 as aligning means to guide and align both of the edges of the sheet discharged by the paired discharge rollers 6 in the width direction of the sheet traversing the sheet bundle feed direction.

Figure 3:
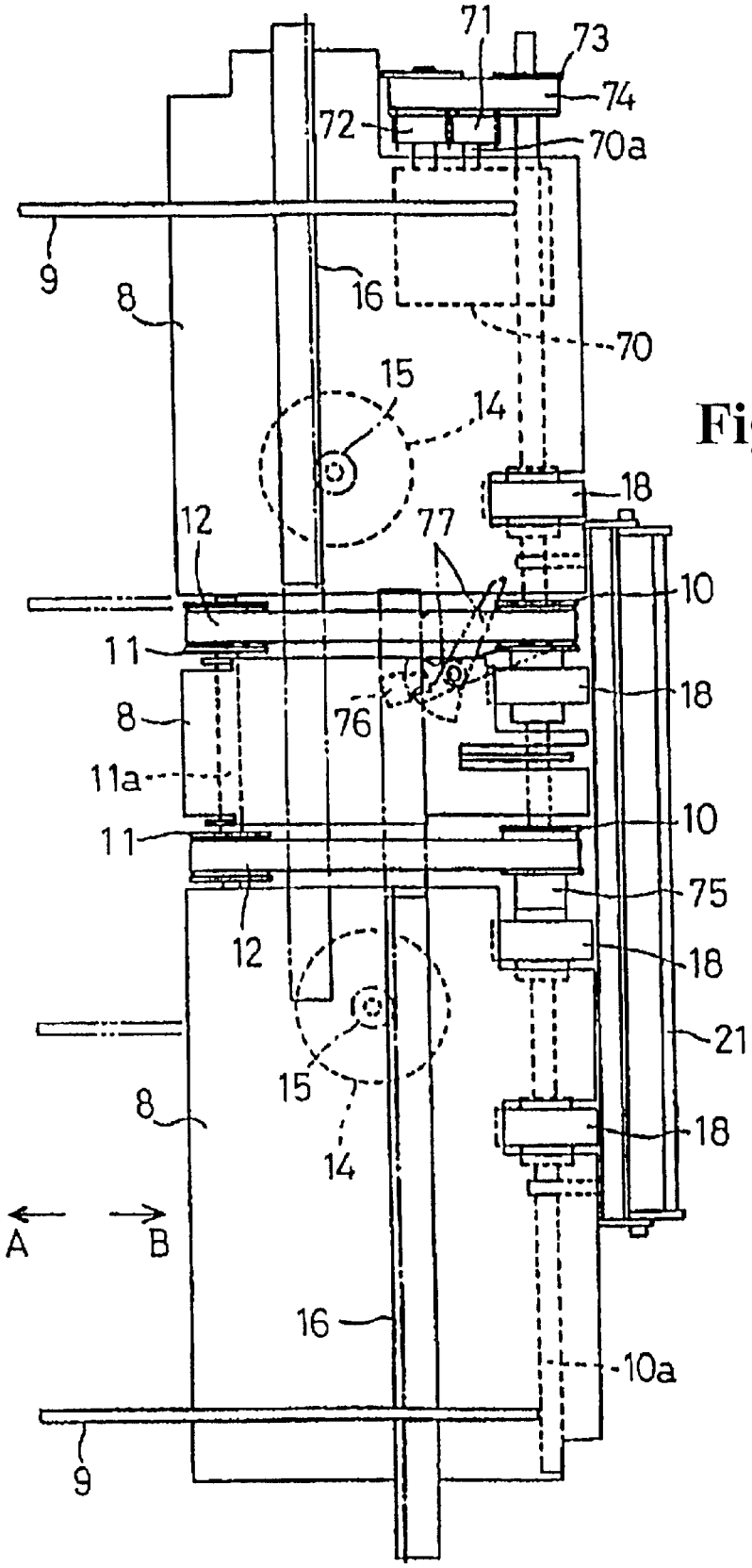
FIG. 3 is a top view for a processing tray of the sheet post-processing apparatus.

Each of the aligning plates 9, as shown in FIG. 3, is arranged on a side of the respective edges in the width direction traversing the sheet feed direction. Each of the aligning plates 9 has a rack 16 that is meshed with a pinion 15 disposed on a shaft of one of aligning motors 14 comprising a stepping motor arranged below the processing tray 8, and moves for the appropriate amount in the sheet width direction by the rotation of the front side aligning motor 14 and the back side aligning motor 14.

The racks 16 can freely make alignment in reference to a center in the width direction of the sheet being delivered or in reference to either right or left edge in the width direction of the sheet according to a type of the copier 20 that can deliver the sheets in the center in the width direction of the sheet or that can deliver the sheets in either right or left edge of the sheets.

The feed guide 7 shown in FIG. 2 is a guide provided for guiding into the processing tray 8 the sheet discharged out of the pair of paired discharge rollers 6. A paddle 17 is disposed below the feed guide 7. The paddle 17 is formed of a semicircular rubber or the like having a fixed elasticity and can be rotated with a center of a shaft 17*a* to contact an upper surface of the sheet to securely feed the sheet.

The paddle 17 also has a fin 17*b* extending radially outwardly from the center of the shaft 17*a* and a paddle surface 17*c* integrated together. The paddle 17 is designed to easily deform as the sheets are stacked in the processing tray 8 so that the sheets can be fed properly.

The processing tray 8 also has a first pulley 10 disposed on a first pulley shaft 10*a* and has a second pulley 11 disposed on a second pulley shaft 11*a*. A feed belt 12 is trained between the first pulley 10 and the second pulley 11. The feed belt 12 has a pressing pawl 13 on the circumference of the feed belt 12.

The first pulley shaft 10*a* has a lower bundle feed roller 18 disposed axially thereon. An upper feed roller 19 is located above the lower bundle feed roller 18 to move between a position (dotted line) where the upper feed roller 19 presses against the lower bundle feed roller 18 and a separating position (solid line) where the upper feed roller 19 separates from the lower bundle feed roller 18.

Figure 4:
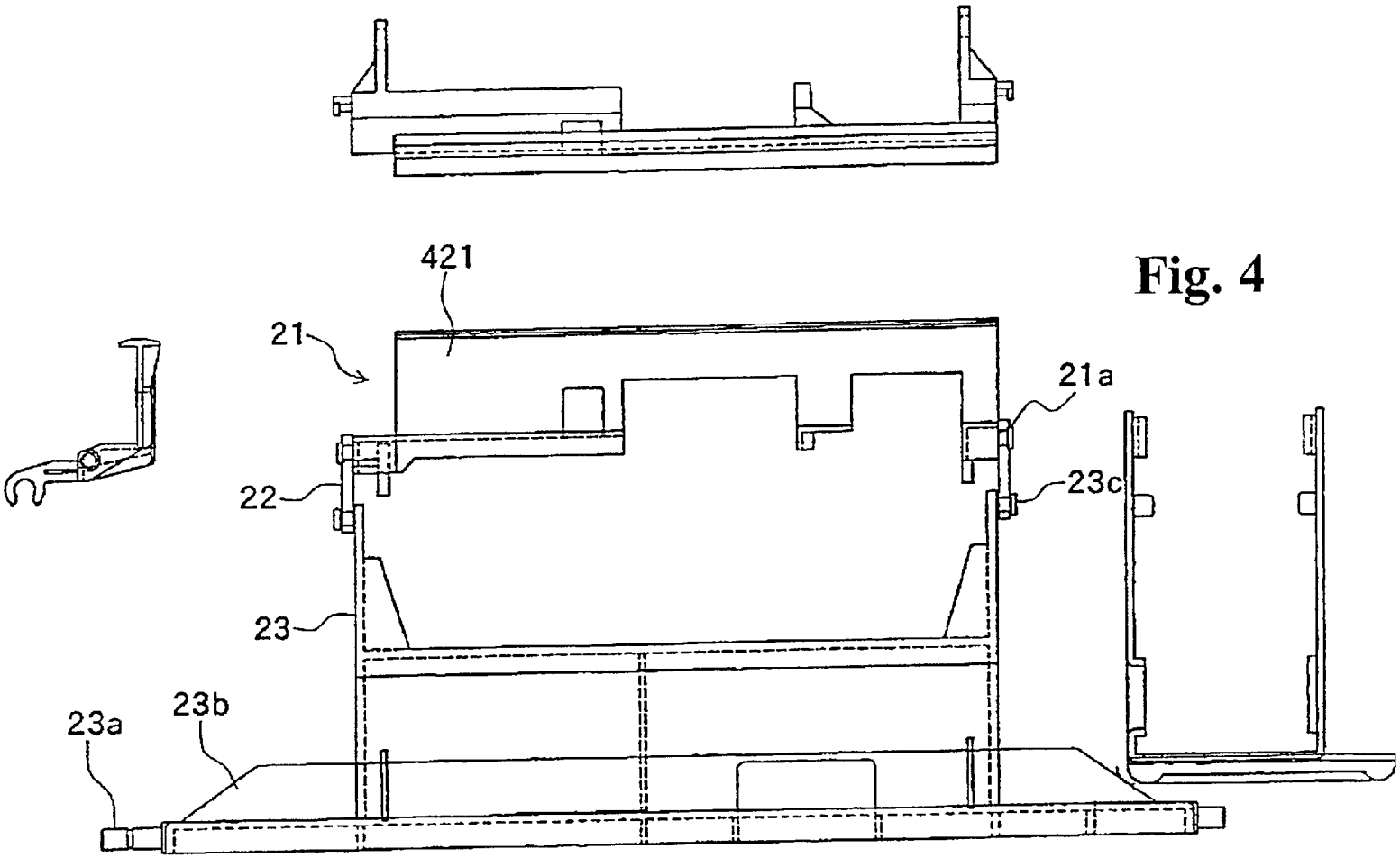
FIG. 4 is a front view for a structure of a stopper disposed in the sheet post-processing apparatus.

In the Figure, a stopper 21 is shown. The stopper 21 has a single stopper plate 421 extending in the width direction of the sheet as shown in FIG. 4. The stopper plate 421 receives and limits the edge of the sheet moved by rotation of the paddle 17, discharged out and dropped by its own weight into the processing tray 8, by the paired discharge rollers 6. In the figure, there is shown a moving arm 23 for moving the stopper 21.

Figure 5:
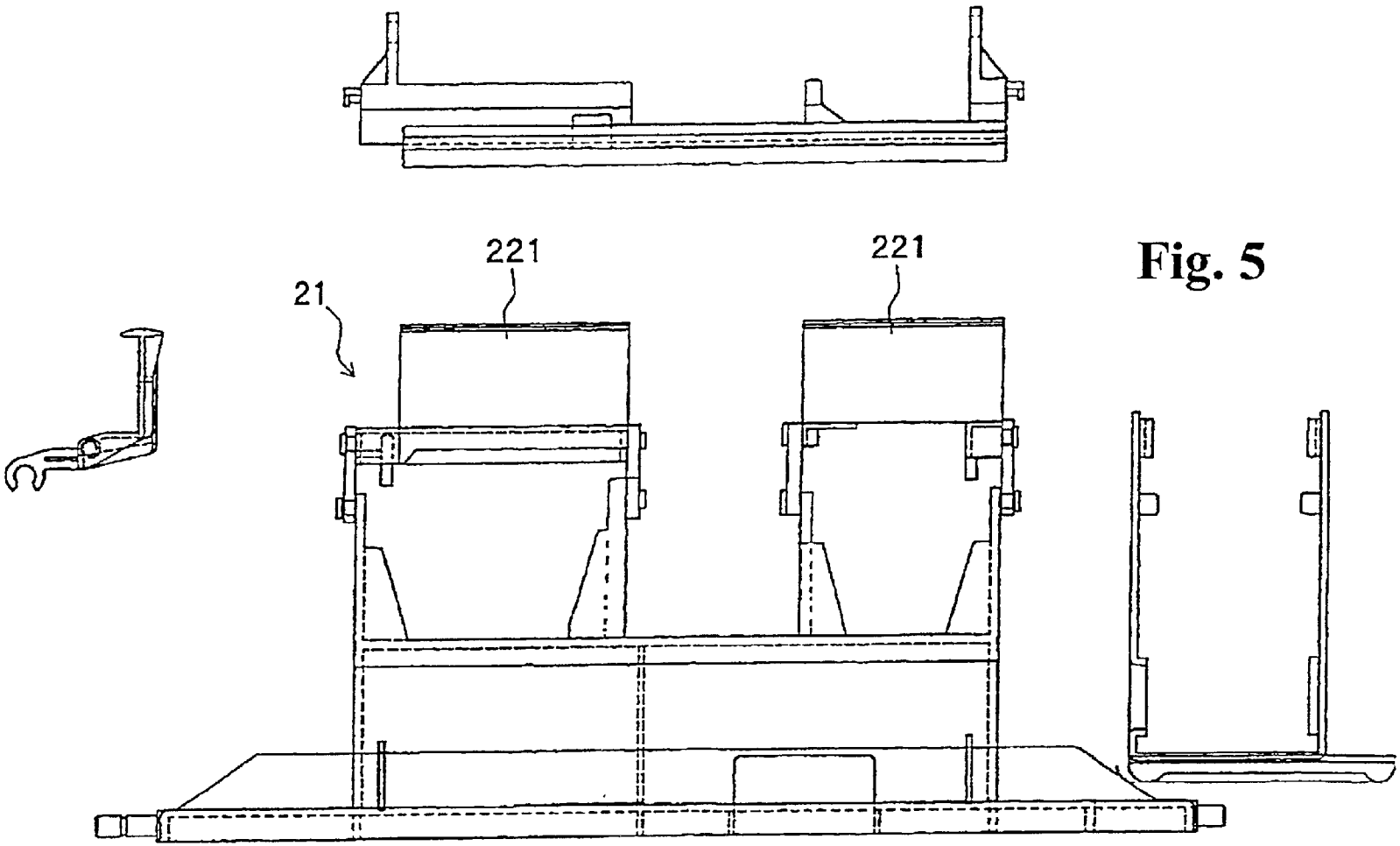
FIG. 5 is a front view for another structure of a stopper disposed in the sheet post-processing apparatus.

The stopper 21, as shown in FIG. 2, is rested at an edge thereof by a first pulley shaft 10*a* and always protrudes toward a position that limits the edge of the sheet by a spring or the like (not shown). In FIG. 4, the stopper 21 is formed of a single plate. Alternatively, as shown in FIG. 5, the stopper 21 may be formed of a plurality of stopper plates 221 disposed in the width direction of the sheet.

The saddle stitching unit 30 for stapling, on the other hand, has a staple driving head unit 31 having a staple cartridge (not shown) and an anvil unit 32 for bending the staple driven out of the staple driving head unit 31, the units 31 and 32 being located below and above a sheet bundle feed path 25 respectively and facing each other. This is assembled as shown by the dotted lines, allowing it to be pulled from the sheet processing apparatus 2.

The staple driving head unit 31 and the anvil unit 32 can be moved to the sheet bundle feed path 25 disposed between the staple driving head unit 31 and the anvil unit 32 in a direction orthogonal to the sheet feed direction (direction from left to right in FIG. 2), the orthogonal direction being a direction along a surface of the sheet bundle facing the staple driving head unit 31 and the anvil unit 32.

Guide rods 33 and 34 are located above and below the staple driving head unit 31 and the anvil unit 32, respectively, to guide the movement of the staple driving head unit 31 and the anvil unit 32 in the width direction thereof. Numerals 35 and 36 are screw shafts that shift both units 31 and 32. An anvil drive shaft 37 and a head drive shaft 38 are drive shafts that make the anvil unit 31 and the staple driving head unit 32 drive and bend the staples respectively. The saddle stitching unit 30 will be described in detail later.

Figure 6:
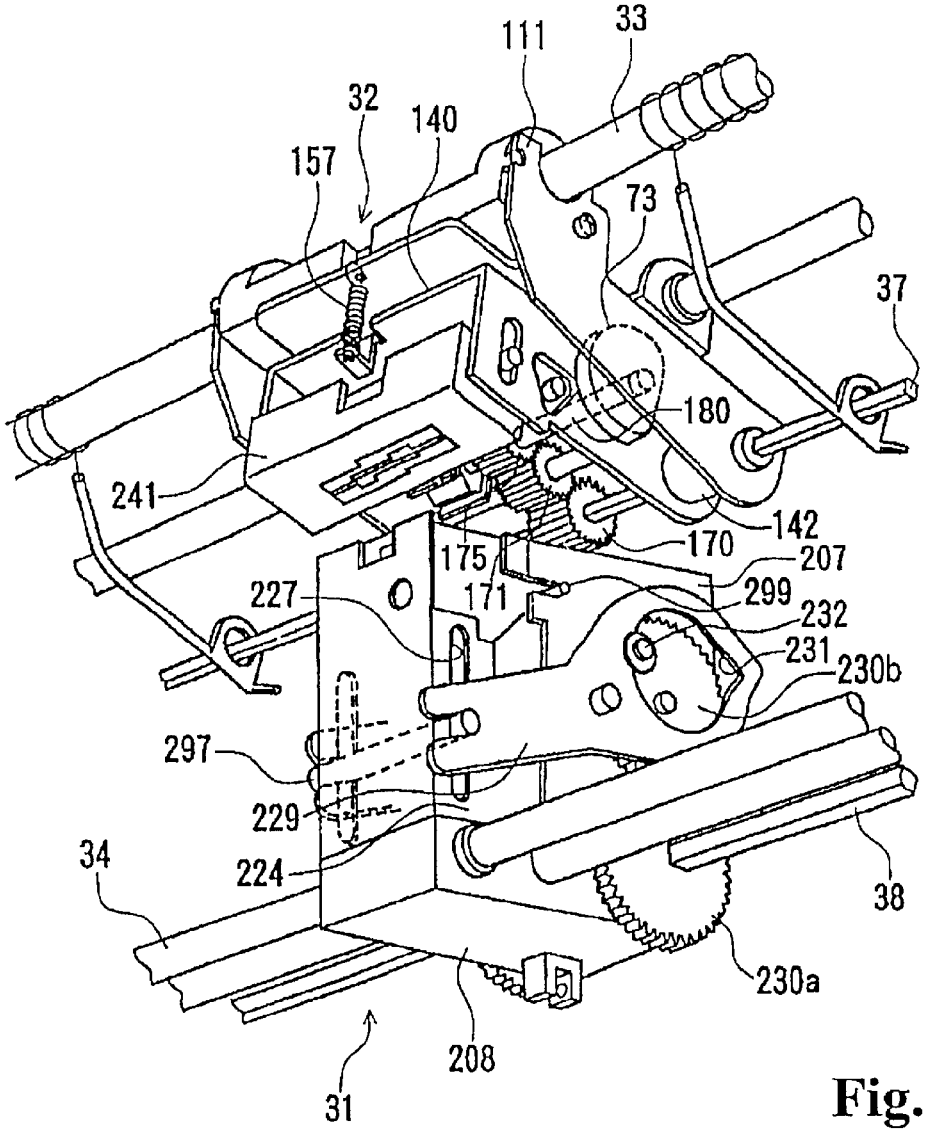
FIG. 6 is a perspective view for a driving mechanism of a saddle stitching unit disposed in the sheet processing apparatus.

A head housing 224, as shown in FIG. 6, is provided in the staple driving head unit 31, which is a base unit having a staple blade (not shown) that is driving means for driving the staples. The guide base block 208 has the guide rod 34 inserted thereinto. The guide rod 34 guides the staple driving head unit 31 (head housing 224) for sliding.

An attachment block 207 is provided on a side of the head housing 224. The attachment block 207 is equipped with transmission gears 230*a* and 230*b* and an arm 229 forming drive means for driving the staple blade in the head housing 224 by a drive force of the head drive shaft 38.

A pin 232 is disposed on the transmission gear 230*b*. The pin 232 is moved along a cam face 231 of the arm 229. With the pin 232 moved, a recess of a tip of the arm 229 makes a pin 297 installed fixedly at the staple blade inside the head housing 224 move along a slit 227 inside the head housing 224, thereby giving a drive force to the staple blade.

Figure 7:
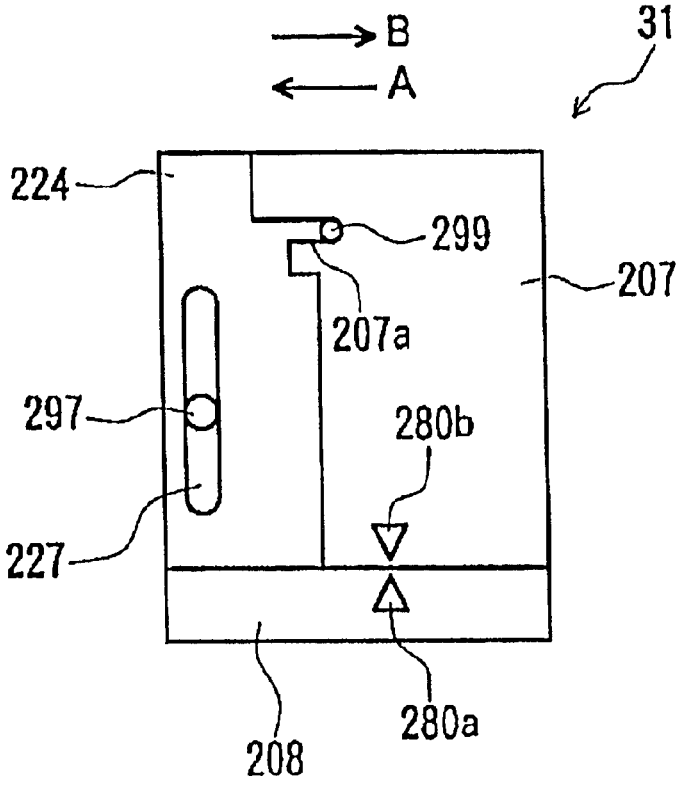
FIG. 7 is a view of a construction of an attachment block, a guide base block, and a head housing of the saddle stitching unit.

In the embodiment, as sown in FIG. 7, the attachment block 207 can be attached to and detached from the head housing 224 (and the guide base block 208) as moved in the arrows A and B directions respectively. A positioning pin 299 for the head housing 224 is usually engaged with a recess 207*a* of the attachment block 207 for positioning and fixed with a screw (not shown).

The guide base block 208 and the attachment block 207 have the positioning sensors 280*a* and 280*b* placed thereon respectively. These positioning sensors 280*a* and 280*b* which are detection means can detect whether the attachment block 207 is attached to the guide base block 208 and the head housing 224 or not and detect whether the attachment block 207 is attached at a correct position or not.

Such an arrangement allows only the attachment block 207 to be removed upon clogging of the staple or similar troubles, thereby increasing maintenance efficiency. The arrangement also allows the head housing 224 having the staple driving staple blade to remain in the apparatus together with the guide base block 208. This does not deviate a precise relative position of the staple blade from an anvil body 241 (FIG. 6) even with the action of attachment and detachment upon maintenance, thereby preventing the staple from stitching error in operation after maintenance and assuring a secure saddle stitching.

Figure 8:
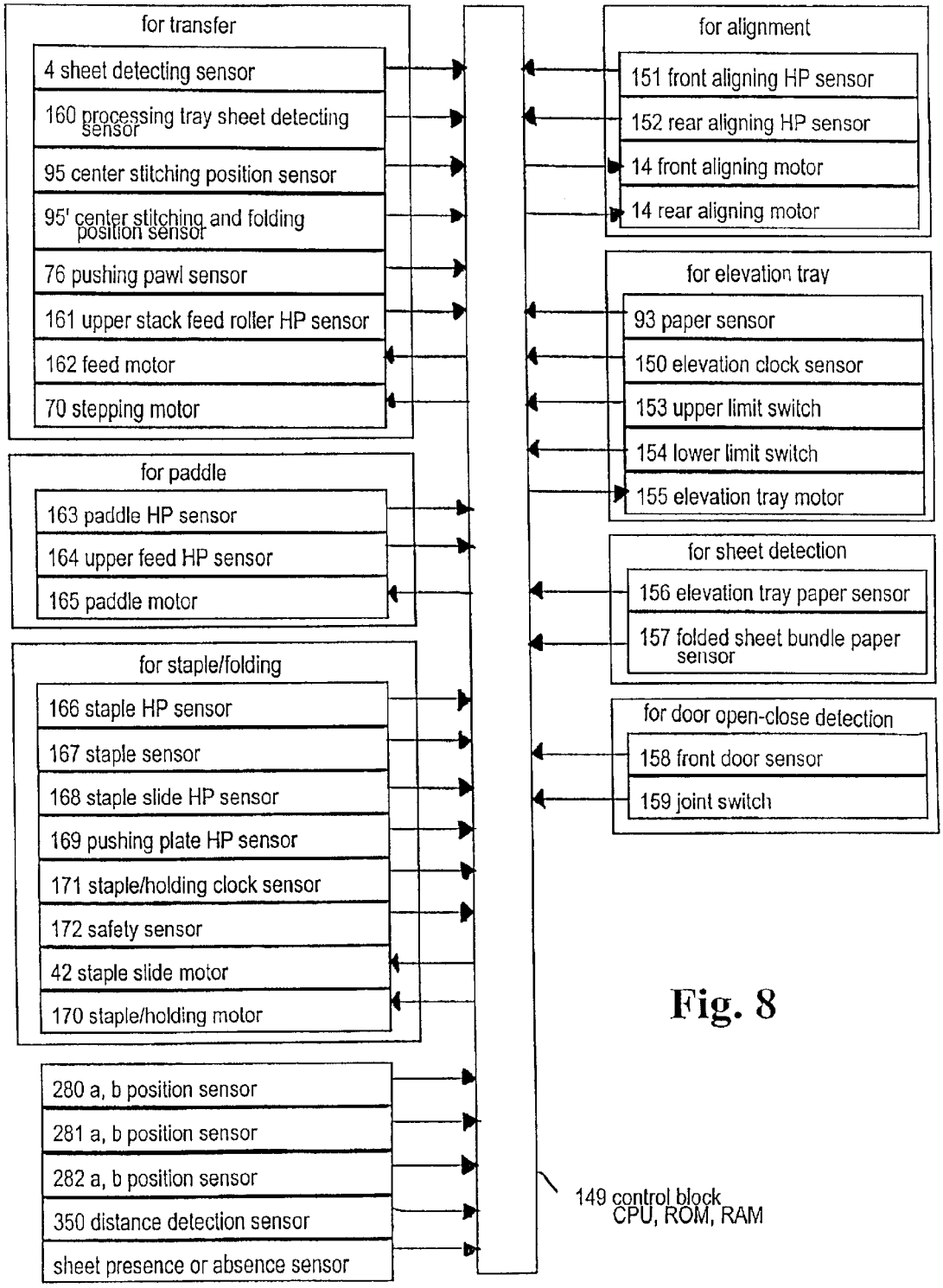
FIG. 8 is a block diagram of the sheet processing apparatus.

Further, detection results of the positioning sensors 280*a* and 280*b* are input to the control block 149 shown in FIG. 8. The control block 149 inhibits the staple driving head unit 31 and the anvil unit 32 from saddle stitching according to the detection results of the positioning sensors 280*a* and 280*b* if the attachment block 280 is not attached at all or has been attached in a position that is incomplete. Such an operation can prevent staple stitching error if a staple is clogged or not driven actually.

Figure 9:
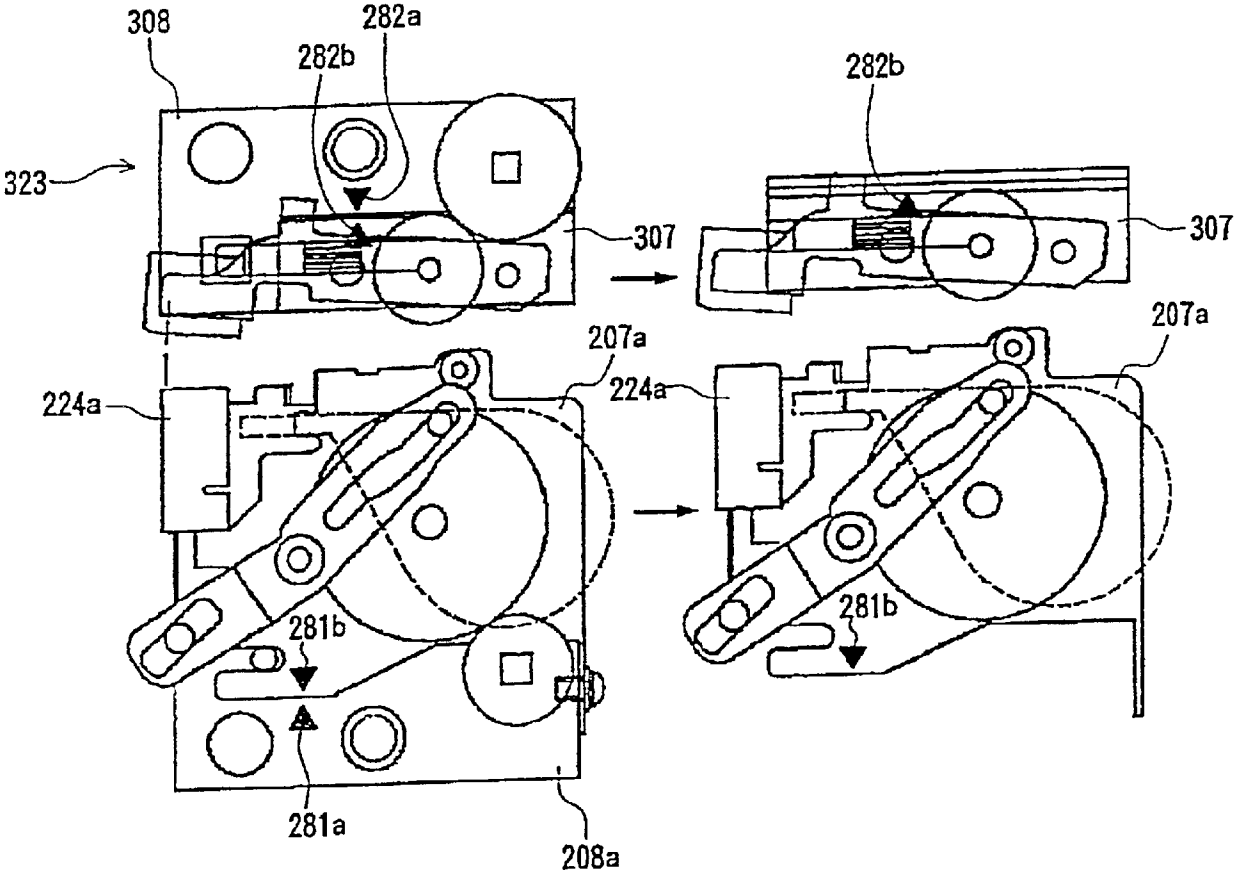
FIG. 9 is a view for another configuration of an attachment block, a guide base block, and a head housing of the saddle stitching unit.

As for the saddle stitching inhibit control according to the detection results of the positioning sensors 280*a* and 280*b* when the attachment block 207 is mounted and removed as in FIG. 7, it may be made possible by such a construction type that the head 224*a* having the staple blade is integrated with the attachment block 207*a* as shown in FIG. 9. For that construction, the detection results are obtained by a positioning sensor 281*a* disposed on a guide base block 208*a* and a positioning sensor 281*b* disposed on the attachment block 207*a*.

As shown in the Figure, it also may be made possible by such an alternative construction that an anvil unit 323 is made of a guide base block 308 and a detachable attachment block 307. For that construction, the detection results are obtained by a positioning sensor 282*a* disposed on the guide base block 308 and a positioning sensor 282*b* disposed on the attachment block 307. That construction is the same as in FIG. 6.

Furthermore, according to this embodiment, it is controlled to prohibit the saddle stitching based on the positioning detection detected by the control block 149 on the sheet post-processing apparatus when the attachment block 207 is mounted and dismounted. However, it may also be made in an alternative way by using an additional control means formed in the saddle stitching unit 30 itself. Still a further alternative method would be to have the control unit 921 formed in the main body 1.

Figure 10:
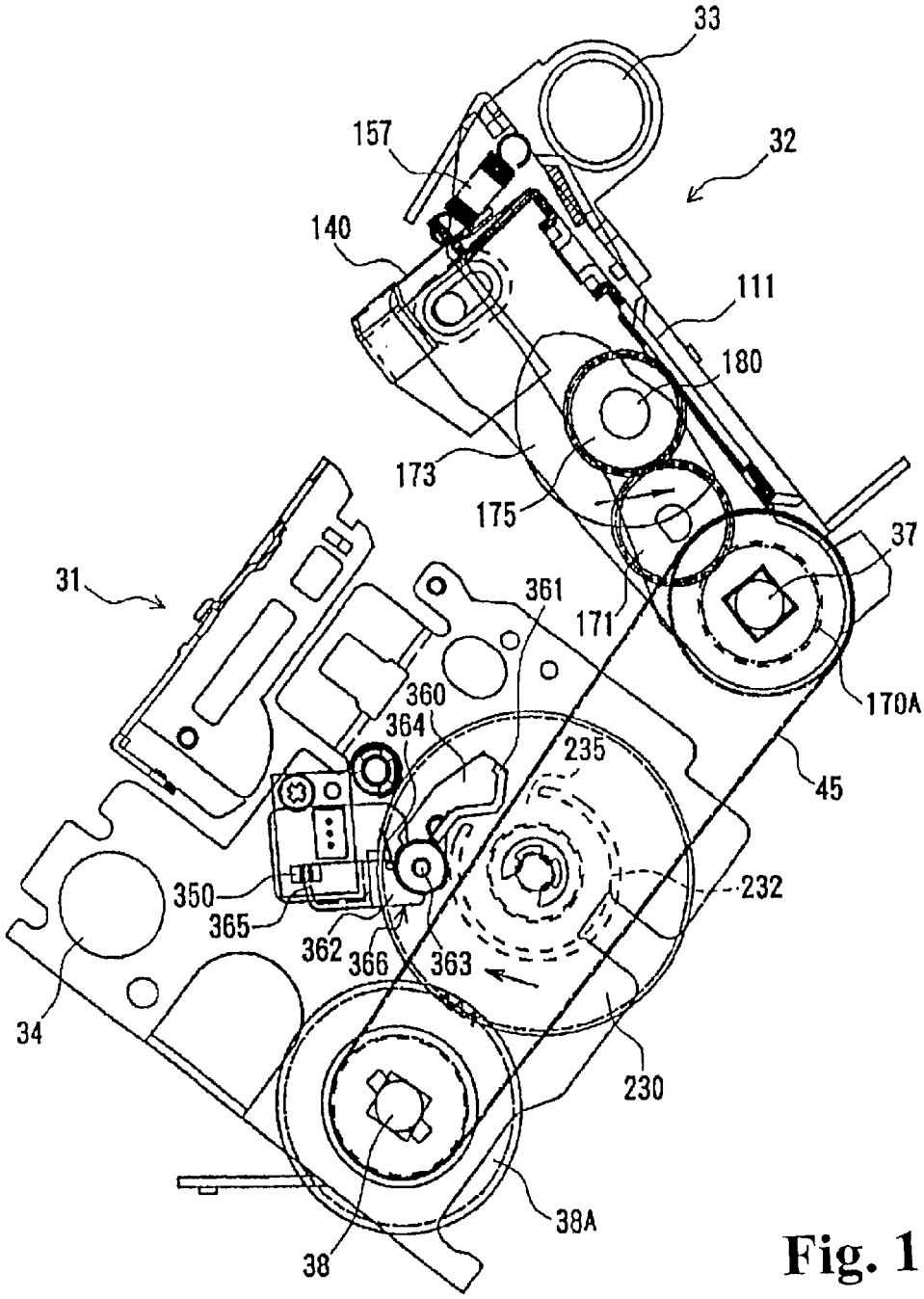
FIG. 10 is a view illustrating a gap detecting sensor disposed on the stitching unit.

In addition, FIG. 10 illustrates that the saddle stitching unit 30 has a gap detecting sensor 350 that can detect a space between the staple driving head unit 31 and the anvil unit 32. Further, the drive force of the drive shaft 38 is transmitted via a timing belt 45 and via a staple/folding motor 170A located on the anvil drive shaft 37 in the anvil unit 32 to a gear 175.

Figure 11:
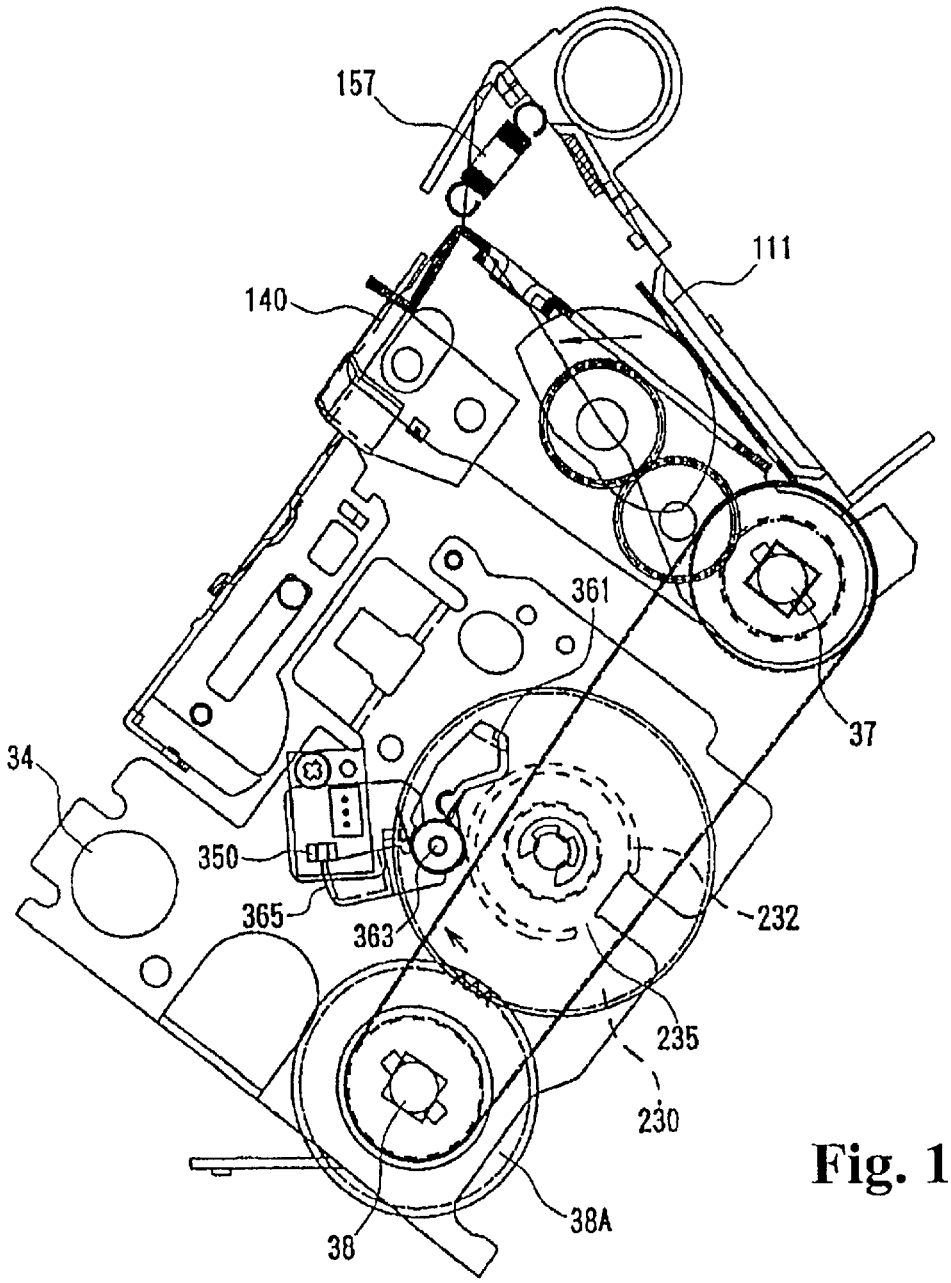
FIG. 11 is a view illustrating a detecting operation of the gap detecting sensor.

With the gear 175 rotated, the cam 173 located on the rotating shaft 180 of the rotating shaft 175 on the gear 175 is pressed to a fixed frame 111 on the anvil unit 32. As a result, a movable frame 140 on the anvil unit 32 supported via a collar 37 on the anvil drive shaft 37 to swing freely, as shown in FIG. 11, resists against the urging force of the coiled spring 157 to separate from the fixed frame 111 toward the staple driving head unit 31.

The drive force of the head drive shaft 38 is transmitted to the gear 230 via the gear 38A located on the head drive shaft 38 in synchronization with the drive force of the head drive shaft 38 that moves the movable frame 140 of the anvil unit 32 via the timing belt 45.

The gear 230, as shown in FIG. 10, has a cylindrical cam 232 having a notch 235 formed thereon. A detecting lever 366 having an engaging portion 360 and a detecting end 362 provided thereon is disposed to swing freely with a center of the shaft 363 being pressed toward the cam 232 by a spring 364.

If the gear 230 is located at a position at which the gap between the staple driving head unit 31 and the movable frame 140 of the anvil unit 32 is fully opened, as shown in FIG. 10, the detecting lever 366 swings so that the engaging portion 360 can be put into the cutout 235 of the cylindrical cam 232 by the spring 364.

With the engaging portion 360 put into the cutout 235 of the cam 232, a detecting tip 365 of the detecting end 362 of the detecting lever 366 is moved to a position at which the detecting tip 365 is detected by the gap detecting sensor 350. As a result, the gap detecting sensor 350 detects the detecting tip of the detecting lever 366.

A signal from the gap detecting sensor 350, as shown in FIG. 9, is input to the control block 149. With the detection of the detecting tip 365 by the gap detecting sensor 350, it is decided that the space between the staple driving head unit 31 and the movable frame 140 of the anvil unit 32 is fully opened as shown in FIG. 10.

On the other hand, if the drive force of the head drive shaft 38 moves the movable frame 140 on the anvil unit 32 via the timing belt 45, as shown in FIG. 11, the gear 364 is rotated via the gear 38A located on the head drive shaft 38 in synchronization with the movement of the movable frame 140. The rotation force resists the urging force of the spring 364 to push the engaging portion 360 of the detecting lever 366 from the notch 235 to press to the engaging surface of the circular cam 232. The engaging portion 360 has a slant surface formed at the tip 360 thereof so that the engaging portion 361 can be pressed up to the engaging surface on the circular cam 232.

Thus, the detecting tip 365 of the detecting end 362 can not be detected by the gap detecting sensor 350 while the engaging portion 360 of the detecting lever 366 is pressed to the engaging surface of the circular cam 232. As the gap detecting sensor 350 does not detect the detecting tip 365, the control block 149 decides that the space between the staple driving head unit 31 and the movable frame 140 of the anvil unit 32 is out of a full open status as shown in FIG. 10.

It is described so far that the control block 149 decides with the signal from the gap detecting sensor 350 whether or not the space between the staple driving head unit 31 and the movable frame 140 on the anvil unit 32 is fully open. Alternatively, a detection range of the gap detecting sensor 350 can be made wider to detect that the space between the staple driving head unit 31 and the movable frame 140 on the anvil unit 32 is made narrow from the full open state to a desired range.

The both units 31 and 32 must be usually moved in the width direction of the sheet bundle if saddle stitching is made at a plurality of positions in the width direction of the sheet bundle or if the staple driving head unit 31 and the anvil unit 32 are moved to a staple replacement position to replace the staples. For the saddle stitching unit 30 in this embodiment, however, the control block 149 inhibits the both units 31 and 32 from moving toward the width direction of the sheet bundle in the condition that the gap detecting sensor 350 detects that the both units 31 and 32 have a space therebetween narrower than a predetermined space (other than the full open status as in FIG. 10).

If the both units 31 and 32 are permitted to move in the width direction of the sheet bundle in the narrow space state, the sheet bundle positioned for saddle stitching at a loading portion between the both units 31 and 32 may contact the staple driving head unit 31 or the anvil unit 32 in a particular case, such as the sheet bundle is floated up by curling or if the sheet bundle is bulky due to too many number of sheets or too thick sheet bundle.

Upon contact with the sheet bundle, the posture of the sheet bundle that has been aligned once deforms. As a result, the sheet bundle is stapled in the deformation state. Therefore, in this embodiment, the posture of the sheet bundle could not be deformed by any contact if the space is detected to exceed the predetermined distance, that is, in the status shown in FIG. 10, the control block 149 then permits the both units 31 and 32 to move in the width direction of the sheet bundle.

However, as will be explained later, there could be a case that a sheet presence detection sensor (not shown) detects that the sheet bundle is not present in the space between the both units 31 and 32. The case occurs, as an example, if the sheet bundle does not reach the space between the both units 31 and 32 in the status that a preguide 370 for guiding the sheet bundle to a feed guide 39 is moved to a predetermined position and stands by, the preguide 370 being a supplement guide member for directing the sheet bundle toward the feed guide 39 which is a guide member for guiding the sheet bundle to the stitching position. This allows the staple driving head unit 31 and the anvil unit 32 to return to a home staple position that will be explained later.

The embodiment makes the above-described movement inhibit to control in the width direction of the sheet bundle by way of detecting the space between the both units 31 and 32 of the saddle stitching unit 30. The way of control can be applied to any type of a mechanism that a stapler having a head and an anvil mechanically combined together other than the saddle stitching can be moved along an edge of the sheet bundle to bind the edge at a plurality of positions. If the space between the head and the anvil is detected to be too narrow, the stapler may be inhibited from moving along the edge of the sheet bundle.

The stapler moving type of the mechanism in the embodiment described above is that the stapler may be inhibited from moving in too narrow gap between the head and the anvil according to the gap detection. For the type of the mechanism that binding is made by the stapler having the head and the anvil mechanically combined together other than the saddle stitching, the sheet stack may be inhibited from moving in too narrow gap according to the gap detection of the head and the anvil. In other words, the relative movement of the sheet stack to the stapler may be inhibited in too narrow gap according to the gap detection between the head and the anvil.

In place of the control block 149 on the sheet post-processing apparatus 2, alternatively, control means may be established in the saddle stitching unit 30 itself so that the control means can control to inhibit the both units 31 and 32 from moving in the width direction of the sheet bundle according to the gap detection between the both units 31 and 32. Still another alternative is that the control unit 921 of the main body 1 may be used to make the control for the image forming system.

The embodiment explained above has the anvil unit 32 moved toward the staple driving head unit 31 thereby changing the gap. Alternatively, the staple driving head unit 31 may be moved toward the anvil unit 32. Still a further alternative could be that both the units be moved toward each other.

It is alternatively possible to form a plurality of gap detection sensors in a structure to automatically set to a predetermined space by selecting a gap detection sensor to be used by control means according to conditions such as the number of sheets, the thickness of the paper of the sheet itself or the humidity or other conditions. The fixed carrying guide 39 guides the sheet stack carried inside the saddle stitching unit 30.

The folding unit 50 for the sheet bundle, on the other hand, is the unit indicated by chain double-dashed line in FIG. 2 and can be drawn out of the sheet post-processing apparatus 2 as in the saddle stitching unit 30. The folding unit 50 has a bundle feed guide 53, upper bundle feed roller 51, a lower bundle feed roller 52, a bundle detecting sensor 54 for detecting a leading edge of the sheet bundle, an abutting plate 55 which is the pressing means, the paired folding rollers 57*a* and 57*b* which are the paired rotating bodies, and leading guide 56 provided therein.

A stack feed guide 53 guides the sheet bundle nipped and fed between the upper feed roller 19 and the lower bundle feed roller 18 located at the inlet of the saddle stitching unit 30. The upper stack feed roller 51 is located at the inlet of the folding unit 50. The lower bundle feed roller 52 is arranged to face the upper bundle feed roller 51.

The upper bundle feed roller 51 is moved between a position (solid line) at which the upper bundle feed roller 51 is pressed to the lower bundle feed roller 52 and a separate position (dotted line). The upper bundle feed roller 51 is moved from the position separated from the lower bundle feed roller 52 to the contact position with the lower bundle feed roller 52 to nip and feed the sheet bundle together with the lower bundle feed roller 52 when the leading edge of the sheet bundle passes between the upper bundle feed roller 51 and the lower bundle feed roller 52 by the upper feed roller 19 and the lower feed roller 18 positioned at the inlet on the saddle stitching unit 30.

A stack detecting sensor 54 for detecting the leading edge of the sheet bundle presses the upper stack feed roller 51 against the lower bundle feed roller 52 when detecting the leading edge of the sheet bundle. The stack detecting sensor 54 is also used to set and control the folding position in the feed direction of the sheet bundle. The paired folding rollers 57*a* and 57*b* are cylindrical rollers having flat parts extending in a width direction thereof. Both the rollers are urged in the directions to press each other when rotated.

The abutting plate 55 is made of a stainless steel plate of around 0.25 mm thick at an edge thereof. The abutting plate 55 is positioned right above the paired folding rollers 57*a* and 57*b*, and a leading edge thereof can be moved close to the nips of the paired folding rollers 57*a* and 57*b*.

Around the upper portion of the paired folding rollers 57*a* and 57*b*, there are formed ark-like backup guides 59*a* and 59*b* to guide and feed the sheet bundle together with the stack feed guide 53. The backup guides 59*a* and 59*b* are interconnected to move with the abutting plate 55 moving up and down to make an opening around the sheet bundle for the paired folding rollers 57*a* and 57*b* when the leading edge of the abutting plate 55 moves close to the nips of the paired folding rollers 57*a* and 57*b*.

The leading guide 56 guides downward the sheet bundle nipped and fed by the upper stack feed roller 51 and the lower bundle feed roller 52 until the leading edge (the downstream edge) of the sheet bundle sags downward at a sheet bundle path 58. In the stack delivery rollers 60*a* and 60*b*, the roller 60*a* is a drive roller, and the roller 60*b* is a driven roller.

A sheet bundle stacking tray 80 for the folded sheet bundles, as shown in the Figure, can stack sheet bundles that have been folded by the paired folding rollers 57*a* and 57*b* and discharged out by the paired bundle discharge rollers 60*a* and 60*b*. The sheet bundle discharged inside the sheet bundle stacking tray 80 is pressed by the folded sheet holder 81 urged downward by a spring or its own weight.

In turn, the following describes the construction of the processing tray 8 and the saddle stitching unit 30 of the sheet processing apparatus 2 in detail.

First, the processing tray 8 is described below. The processing tray 8, as shown in FIG. 3, has a first pulley 10 and a second pulley 11 disposed virtually at a center thereof. The first pulley 10 and the second pulley 11 have a transfer belt 12 trained therebetween. On the first pulley shaft 10*a*, lower bundle feed rollers 18 are formed in two locations on each side of the sheet and substantially at the center of the sheet in the width direction thereof, the lower bundle feed rollers 18 being tire-like hollow rollers.

The first pulleys 10 are driven to rotate by the counter-clockwise rotation of the first pulley shaft 10*a* in FIG. 2 with a one-way clutch 75 interposed between the first pulleys 10 and the first pulley shaft 10*a*, and made for free driving to stop by clockwise rotation of the first pulley shaft 10*a*. The first pulley shaft 10*a* is interconnected via the pulley 73 fixed to the first pulley shaft 10*a*, the timing belt 74, and gear pulleys 72 and 71 to the motor shaft 70*a* on the stepping motor 70 which serves as a source for the feed drive.

Therefore, the lower bundle feed roller 18 fixed to the first pulley shaft 10*a* is driven to rotate when the stepping motor 70 rotates to move the sheet on the processing tray 8 toward the staples in FIG. 2 (in the direction of the arrow B in FIGS. 2 and 3). The feed belt 12, however, is stopped because no drive force is transmitted thereto because of the one-way clutch 75. If the stepping motor 70 rotates to move the sheet toward the sheet elevator tray 90, the lower bundle feed roller 18 and the feed belt 12 rotate toward the sheet elevator tray 90 (in direction of arrow A in FIGS. 2 and 3).

Figure 12:
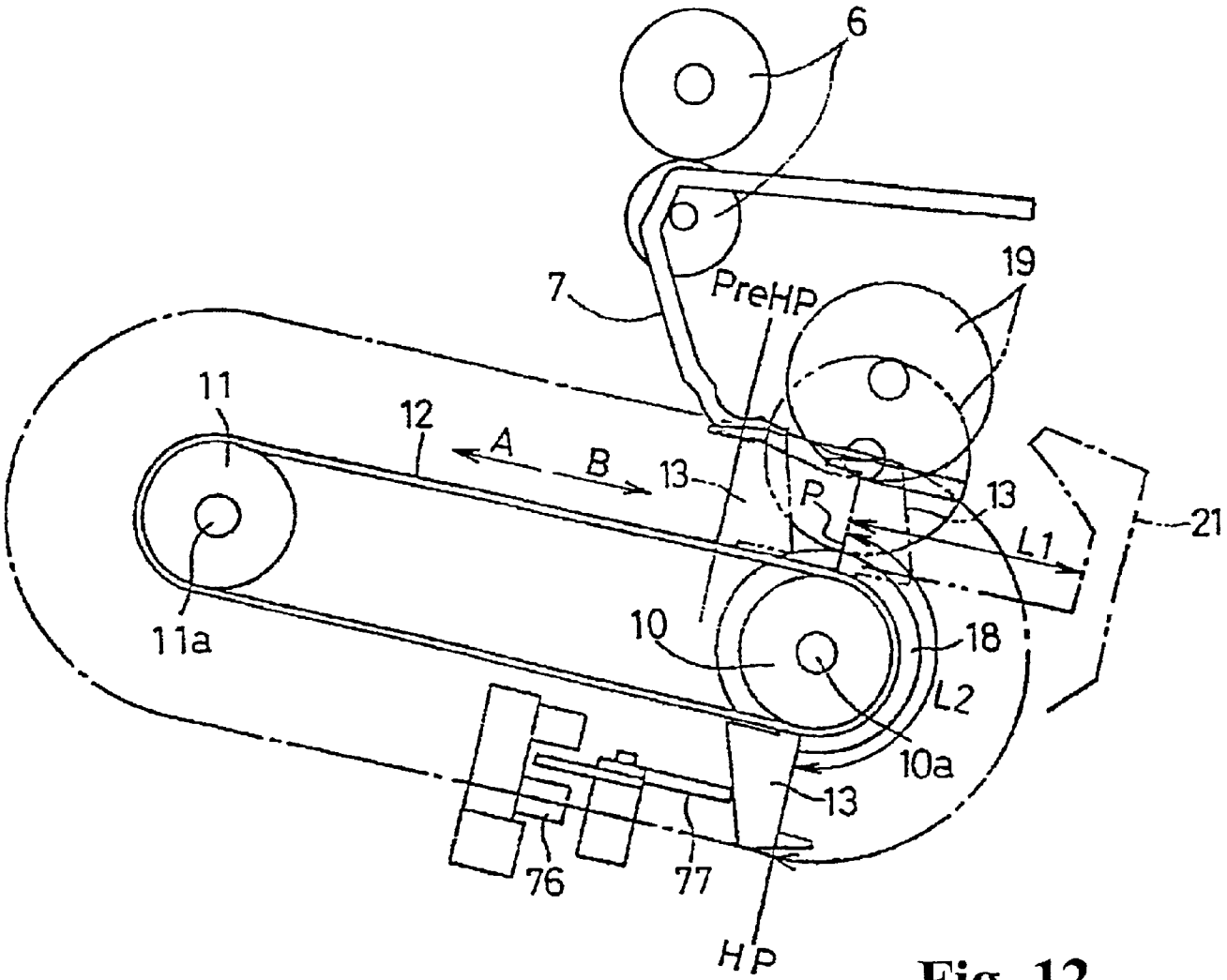
FIG. 12 is a top view for a transfer belt of the sheet processing apparatus.

The transfer belt 12, as shown in FIG. 12, has a pushing pawl 13 disposed thereon. The processing tray 8 has a pushing pawl sensor 76 and a pushing pawl detecting arm 77 disposed thereunder to determine a home position thereof for the pushing pawl 13. In this embodiment, the home position (HP) is determined at the position where the pushing pawl sensor 76 is turned from OFF to ON as the pushing pawl detecting arm 77 is pressed by the pushing pawl 13 moved together with the feed belt 12.

In the Figure, let P denote a nip for the lower bundle feed roller 18 and the upper feed roller 19, L1 a length from the nip P to the stopper 21, and L2 a length from the nip P to the pushing pawl 13 along the feed belt 12. L1 and L2 are set as L1<L2.

In turn, the following describes the sheet feed operation of the processing tray 8 explained above in construction. To feed the sheet bundle to the elevator tray 90, first, a cam or the like (not shown) moves the upper feed roller 19 below the lower feed roller 19 to nip the sheet bundle together with the lower feed roller 19. Second, the stepping motor 70 (FIG. 3) is rotated to rotate the first pulley shaft 10*a* counterclockwise. The lower feed roller 19 then is rotated to move the sheet bundle toward the elevator tray 90 in the arrow A direction.

Note that also that the upper feed roller 19 is rotated by the stepping motor 70. Therefore, the sheet bundle is moved in the direction of the arrow A from the position of the stopper 21 inside the saddle stitching unit 30, by the rotation of the lower bundle feed roller 18 and the upper feed roller 19. When the sheet bundle passes the nip position P, the pushing pawl 13 hits with rotation of the feed belt 12. With the pushing pawl 13, the sheet bundle is fed to the elevator tray 90 while being pressed in the direction of the arrow A.

Because of L1<L2 in the length relationship mentioned above, the pushing pawl 13 presses the bottom of the sheet bundle upward (from the right side in FIG. 12), thereby always pressing the edge of the sheet bundle in an upright status. This does not cause excess stress in the transferring of the sheet bundle.

To feed the sheet bundle toward the saddle stitching unit 30 for saddle stitching, on the other hand, the pushing pawl 13 move counterclockwise from the HP position (FIG. 12) before receiving the sheet bundle moved from the stopper 21 by the paired rollers 18 and 19 synchronized therewith to feed the sheet bundle and push it out.

However, if the sheets fed into the processing tray 8 are not saddle-stitched by the saddle stitching unit 30, the sheet bundle does not need to move to feed the sheet bundle to the stopper 21 position. The stepping motor 70 is driven in advance to move the pushing pawl 13 from the HP position in FIG. 12 to a movement idle position (Pre-HP position) by a predetermined distance a from the nipping position of the lower bundle feed roller 18 and the upper feed roller 19 in a direction toward the elevator tray 90.

The distance (L2+$\alpha$) from the HP position to the Pre-HP position can be set by changing a step number count of the stepping motor 70. If the present sheet processing apparatus 2 needs no saddle stitching for sheets, therefore, the sheets may not be transferred to the stopper 21, but the pushing pawl 13 can be moved to the Pre-HP position in advance to stack the sheets on the elevation tray 90 before pushing the sheet stack out. This means that the sheet post-processing apparatus 2 is available for a high-speed duplicating machine.

Note that if the Pre-HP position of the pushing pawl 13 is a position where the feed guide 7 and the top of the pushing pawl 13 overlap each other, as shown in the Figure, the sheets fed one by one can be securely stacked at the Pre-HP position where the pushing pawl 13 exists. Such an arrangement allows the pushing pawl 13 to deliver the sheet bundle to the elevator tray 90 quickly.

Figure 13:
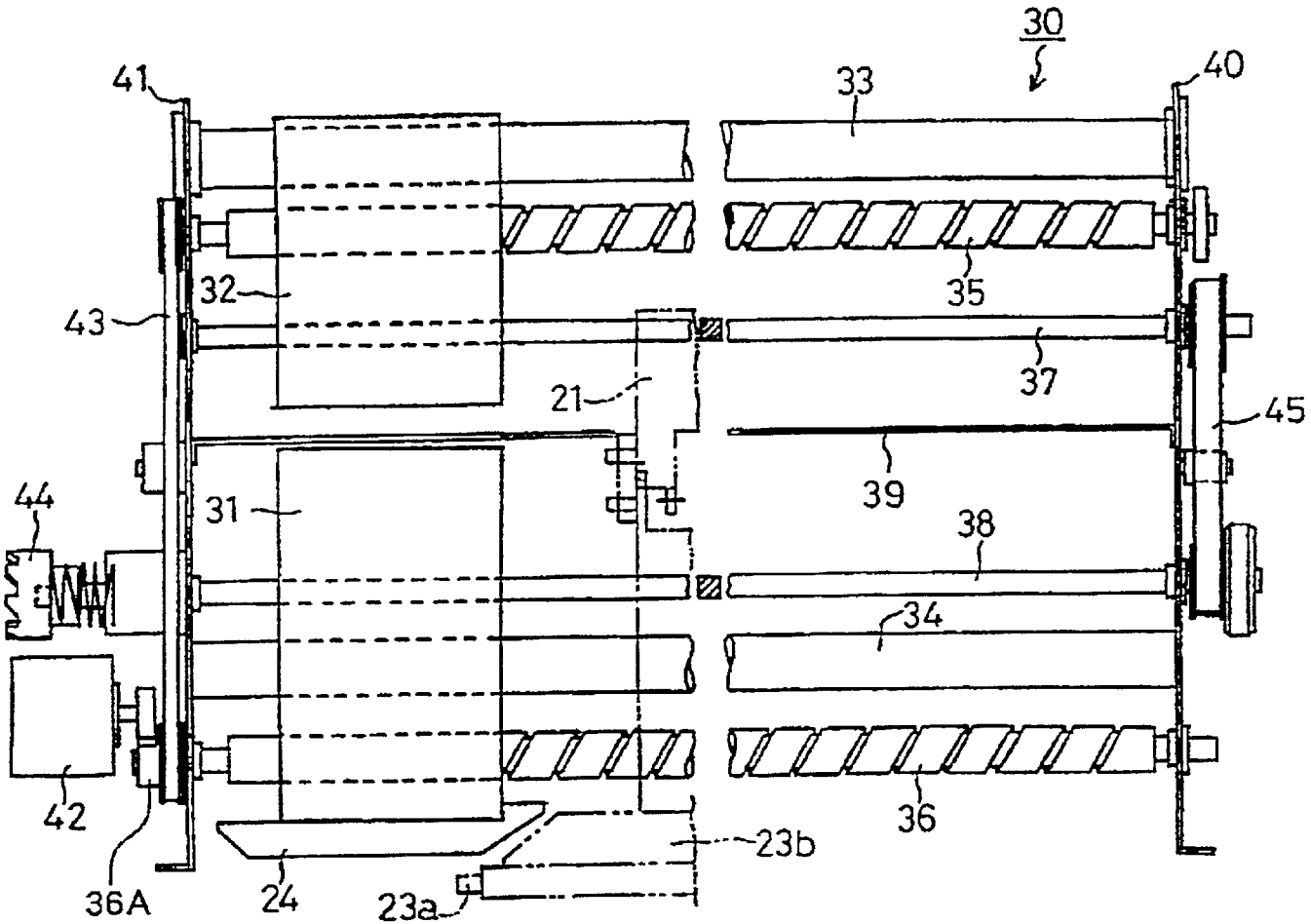
FIG. 13 is a view for a home position of the saddle stitching unit.

In turn, the following describes the saddle stitching unit 30. The saddle stitching unit 30, as shown in FIG. 13, has right and left unit frames 40 and 41, guide rods 33 and 34, screw shafts 35 and 36, and drive shafts 37 and 38 situated between the frames 40 and 41, the anvil unit 32 thereabout and the staple driving head unit 31 thereunder.

The screw shaft 36 is engaged with the staple driving head unit 31. The staple driving head unit 31 is moved in the horizontal direction in the Figure by rotation of the screw shaft 36. The anvil unit 32 also is arranged similarly.

The screw shaft 36 is connected with the stapler slide motor 42, which is the moving means, via the gear 36A outside the unit frame 41. Drive force of the stapler slide motor 42 is transmitted also to the anvil unit 32 by a timing belt 43. This allows the staple driving head unit 31 and the anvil unit 32 to move in a direction (horizontal direction in FIG. 13) without deviation of vertical positions thereof.

The stapler slide motor 42, therefore, can be driven to control the staple driving head unit 31 and the anvil unit 32 to move to a desired position depending on the width of the sheet, thereby allowing the staples to be driven at desired positions.

Figure 14:
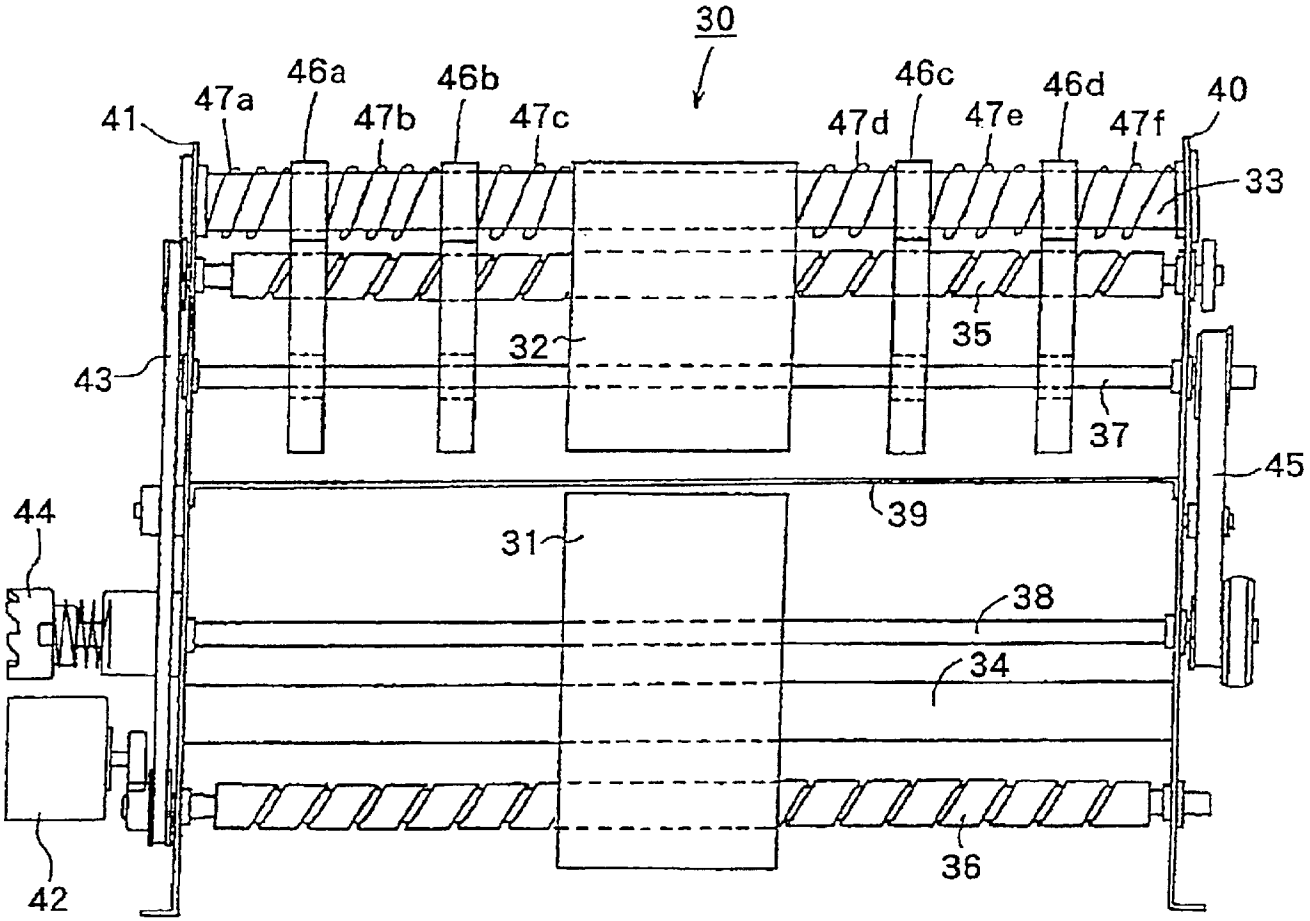
FIG. 14 is a top view illustrating a construction of the saddle stitching unit.

Top guides 46*a*, 46*b*, 46*c*, and 46*d*, which are float preventing guide members, are movably supported on the guide rod 33 and the anvil drive shaft 37 above the sheet bundle feed path 25 (FIG. 2) in an area surrounded by the anvil unit 32 and the right and left unit frames 40 and 41 as shown in FIG. 14.

Compression springs 47*a*, 47*b*, 47*c*, 47*d*, 47*e*, and 47*f* of an elastic material are interposed between the unit frame 41 and the upper guide 46*a*, between the upper guide 46*a* and the upper guide 46*b*, between the upper guide 46*b* and the anvil unit 32, between the anvil unit 32 and the upper guide 46*c*, between the upper guide 46*c* and the upper guide 46*d*, and between the upper guide 46*d* and the unit frame 41, respectively. The top guides 46*a*, 46*b*, 46*c*, and 46*d* move on the upper guide rod 33 and the anvil drive shaft 37 in coordination with the movement of the anvil unit 32.

Figure 15:
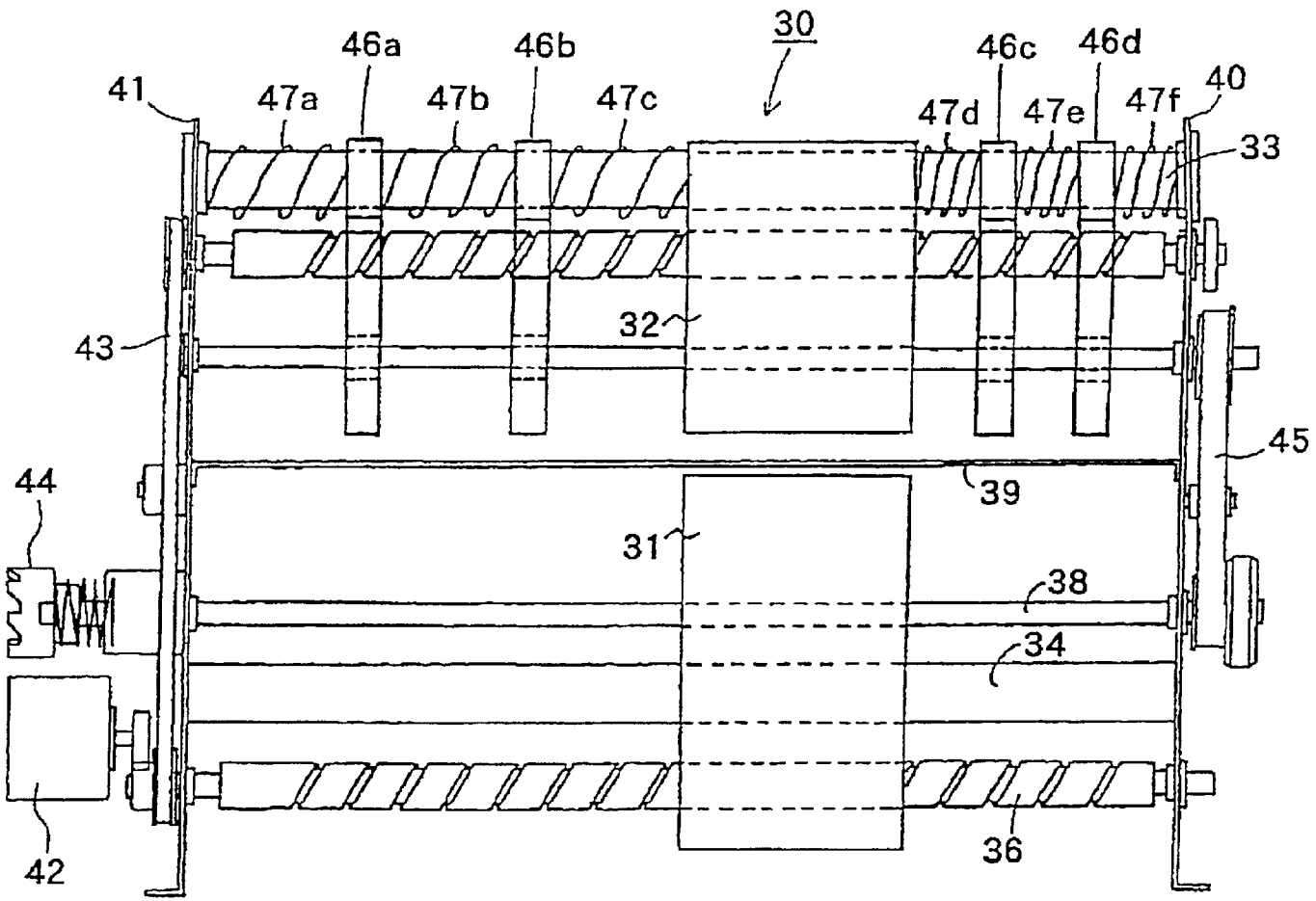
FIG. 15 is a top view for the saddle stitching unit moved to a stitching position.

As an example, if the sheet bundle is saddle stitched on a right side thereof, as shown in FIG. 15, the staple driving head unit 31 and the anvil unit 32 move to desired stitching positions on the right side from the position shown in FIG. 14 while keeping a relative positional relationship therebetween. Along with the movement, the compression springs 47*d*, 47*e*, and 47*f* on the right side are compressed by the anvil unit 32 in coordination with the movement of the anvil unit 32. The top guides 46*c* and 46*d* are moved to the right side as pushed by the compression springs 47*d* and 47*e*.

The compression springs 47*a*, 47*b*, and 47*c* placed to the left side of the anvil unit 32, on the other hand, are extended in coordination with the movement of the anvil unit 32. The top guides 46*a* and 46*b* also move to the right side to serve for guiding at desired positions depending on sheet stitching positions.

The drive forces for moving the head to drive the staples in the staple driving head unit 31, to move the staples, and to bend the staples in the anvil unit 32 are provided through the coupling device 44 from the sheet processing apparatus 2 and are also transmitted to the anvil unit 32 through the timing belt 45 on the unit frame 40.

Figure 16:
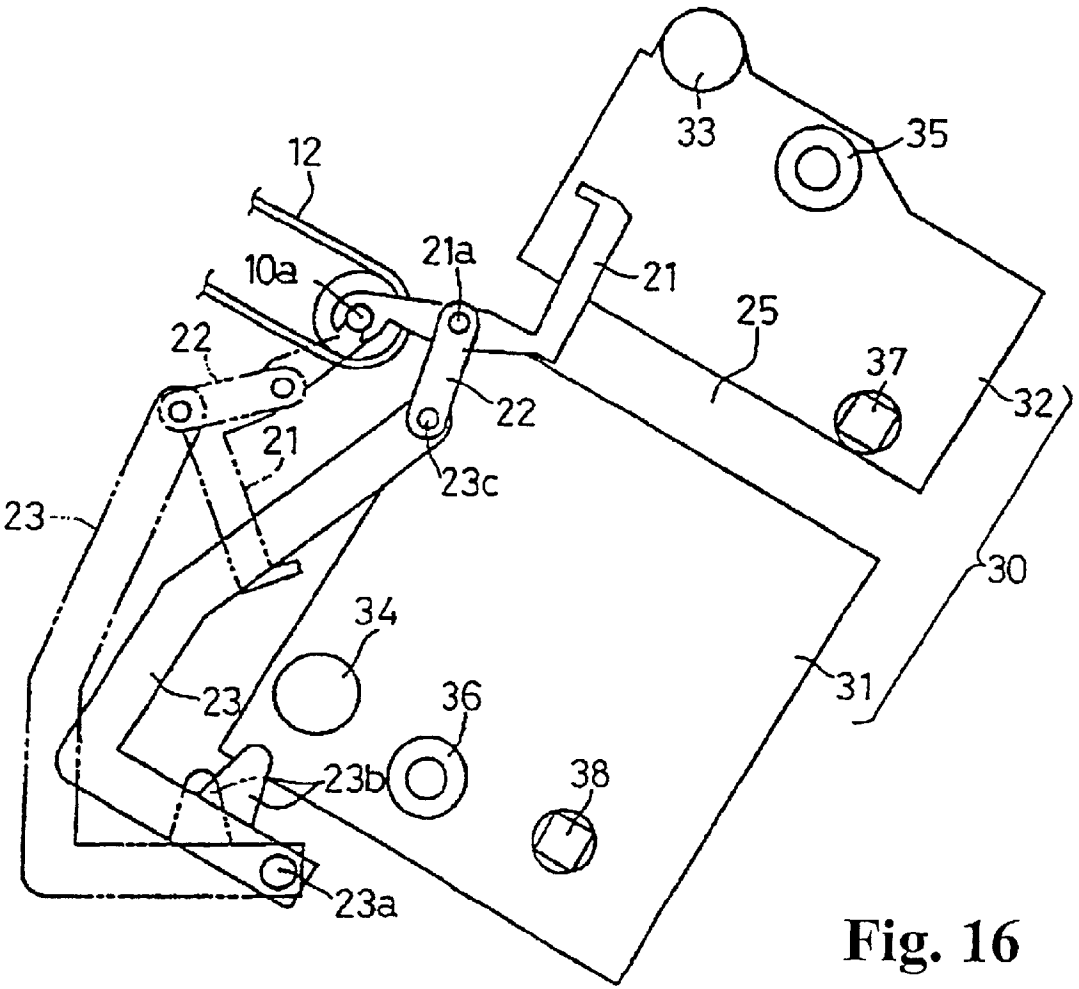
FIG. 16 is a view for a stopper operation in the sheet processing apparatus.

FIG. 16 shows parts of a side of the saddle stitching unit 30. The stopper 21 is connected with the moving arm 23 by the connecting pin 23*c*, the connecting lever 22, and the connecting pin 21*a*. The stopper 21 is pivoted by the first pulley shaft 10*a*.

The following describes the appearance and disappearance of the stopper 21 in the sheet bundle feed path 25 to set the staple driving positions on the edge of the sheet bundle with the staple driving head unit 31 moved in the width direction of the sheets, in reference to FIGS. 13 and 16.

Below the head unit 31, as shown in FIG. 13, the stopper abutting protrusion 24 is disposed to engage the stopper 21 with the moving arm 23. The movement of the head unit 21 causes the stopper abutting protrusion 24 to abut against the moving arm protrusion 23*b*, which in turn causes the moving arm 23 to rotate around the turning shaft 23*a* in the counter-clockwise direction moving to the position of the dotted lines, as can be seen in FIG. 16. With the movement, the stopper 21, therefore, can not prevent the staple driving head unit 31 and the anvil unit 32 from moving in the width direction of the sheet bundle.

In the above-mentioned operational construction that the movement of the staple driving head unit 31 makes the stopper engaging projection 24 engage the moving arm projection 23*b*, a plurality of stoppers 221 forming the stopper 21 as shown in FIG. 5, may be alternatively placed in position and can all be saved from the staple path and the feed path 25.

Figure 17:
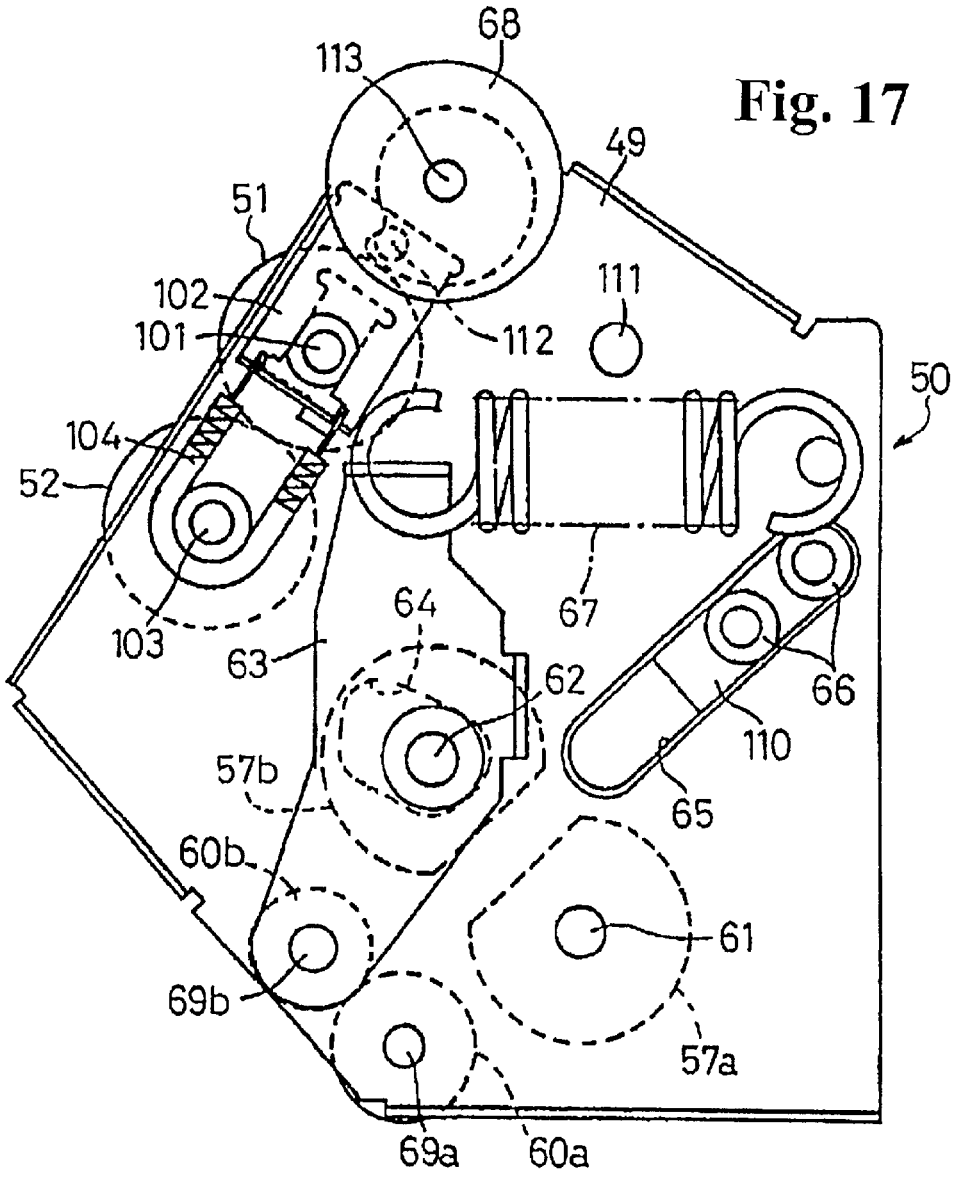
FIG. 17 is a front view of the folding unit frame of the sheet processing apparatus.

In turn, the following describes the folding unit 50. FIG. 17 is a front view of the unit frame 49 of the folding unit 50. Note that the back side of the frame, not shown in the drawing, is made in a shape similar to the folding unit 50 that is drawably disposed to the sheet processing apparatus 2.

The drive shaft 61 on one folding roller 57*a* and the drive shaft 69*a* for the bundle discharge roller 60*a* are disposed on the folding unit frame 49. Note that the drive shaft 62 for the other folding roller 57*b* is mounted to the folding roller holder 63 that turns as a pivot for the drive shaft 69*b* for the bundle discharge 60*b*.

A tensile spring 67 having a tensile force of about 5 N is stretched between the folding roller holder 63 and the unit frame 49. The unit frame 49 has a frame guide 64 formed thereon to allow the drive shaft 62 to move by the folding roller holder 63. If the pair of folding rollers 57*a* and 57*b* fold and transport the sheet bundle, therefore, the tensile spring 67 is able to apply a certain pressure to the sheet bundle, assuring that the sheet stack can be folded securely.

The folding frame 49 has an abutting plate frame guide 65 formed therein that is a long hole to guide rollers 66 stood on a support holder 110 for supporting the abutting plate 55. The abutting plate frame guide 65 allows the abutting plate 55 to move toward the pair of folding rollers 57*a* and 57*b*.

Furthermore, the drive shaft 111 that rotates the cam plate 114 indicated in FIGS. 18(*a*) and 18(*b*), described later, to move the abutting plate 55, the bundle transport upper roller 51 and the roller shafts 101 and 103 on the bundle transport lower roller 51 to transport the sheet bundle into the folding unit 50 is mounted to the folding unit frame 49. The unit frame 49 also has a mechanism for positioning the upper stack carrying roller 51 away from the lower carrying roller 52 until the sheet bundle is transported into the folding unit 50.

The bundle transport roller shaft 101 on the bundle transport roller 51 is supported on the bearing holder 102, one edge thereof being mounted with the cam follower 112. The cam follower 112 is engaged with an upper roller moving cam 68 placed rotatably on the unit frame 49.

Between the other edge of the bearing holder 102 and the bundle transport lower roller shaft 103, there is stretched the tensile spring 104 with the tensile strength of approximately 0.3 N to constantly urge the bundle transport upper roller 51 toward the bundle transport lower roller 52. With the upper roller moving cam 68 rotated, the bearing holder 102 resists against or is pulled by the tensile spring 104 to move up and down for moving the upper stack carrying roller 51 between the position away from the lower carrying roller 52 and a pressing position.

Figure 18B:
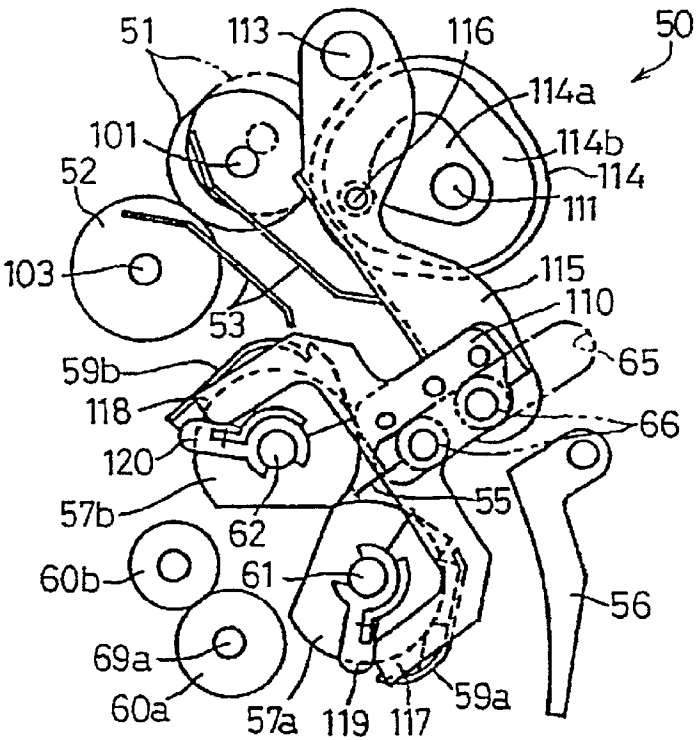
FIGS. 18(*a*) and 18(*b*) are explanatory views of the folding unit operation.
Figure 18A:
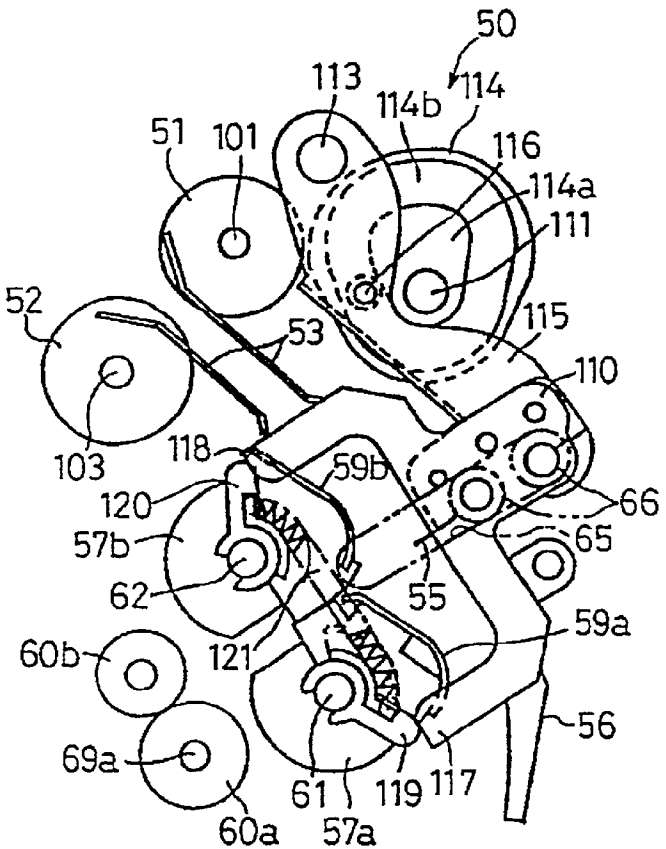

FIGS. 18(*a*) and 18(*b*) show the mechanism for folding of the folding unit 50 and is disposed inside the folding unit 49 shown in FIG. 17. As shown in the same drawings, the fixed frame 111 has a cam plate 114 fixed thereon. The fixed frame 111 is rotated to drive the cam plate 114 to rotate. The cam plate 114 is disposed with the cam groove 114*b*. The cam follower 116 is formed substantially in the center of a turnable actuating arm 115 with a fulcrum of a shaft 113 on this cam groove 114*b*.

The actuating arm 115 has the abutting plate 55 placed at a leading end thereof via the support holder 110. With the cam plate 114 driven to rotate, therefore, the actuating arm 115 also is moved up and down to move the abutting plate 55 placed on the actuating arm 115 up and down.

In turn, the support holder 110 supporting the abutting plate 55 is interconnected with the backup guides 59*a* and 59*b* for guiding around the pair of folding rollers 57*a* and 57*b*. The backup guides 59*a* and 59*b* rotate around the outer circumference of the paired folding rollers 57*a* and 57*b* on the shafts 61 and 62 of the paired folding rollers 57*a* and 57*b*.

While the backup guides 59*a* and 59*b* are respectively pulled by the spring 121, to the outer edges are disposed the lever tips 119 and 120 which are supported to abut against actuating tips 117 and 118 forked of the support holder 110 to support the same.

Before folding the sheet bundle, the backup guides 59*a* and 59*b* are disposed in positions that cover the outer circumferences of the transport path of the paired folding rollers 57*a* and 57*b*, as can be seen in FIG. 18(*a*). This allows the sheet bundle to be guided to completely contact with the rubber surface of the paired folding rollers 57*a* and 57*b*. In this state, the backup guides 59*a* and 59*b* function to backup or support and to guide the sheet bundle. It should be noted that the backup guides 59*a* and 59*b* also function usually as lower carrying guides for the sheet stack together with the stack carrying guide.

In folding the sheet stack, as shown in FIG. 18(*b*), the lever tips 119 and 120 are pressed up according to a downward movement of the actuating tips 117 and 118 of the support holder 110. The result is that the backup guides 59*a* and 59*b* resist the spring 121 and rotate around the shafts 61 and 62. By this rotation of the backup guides 59*a* and 59*b*, the sheet bundle surely contacts the outer circumference of the paired folding rollers 57*a* and 57*b*.

Figure 19:
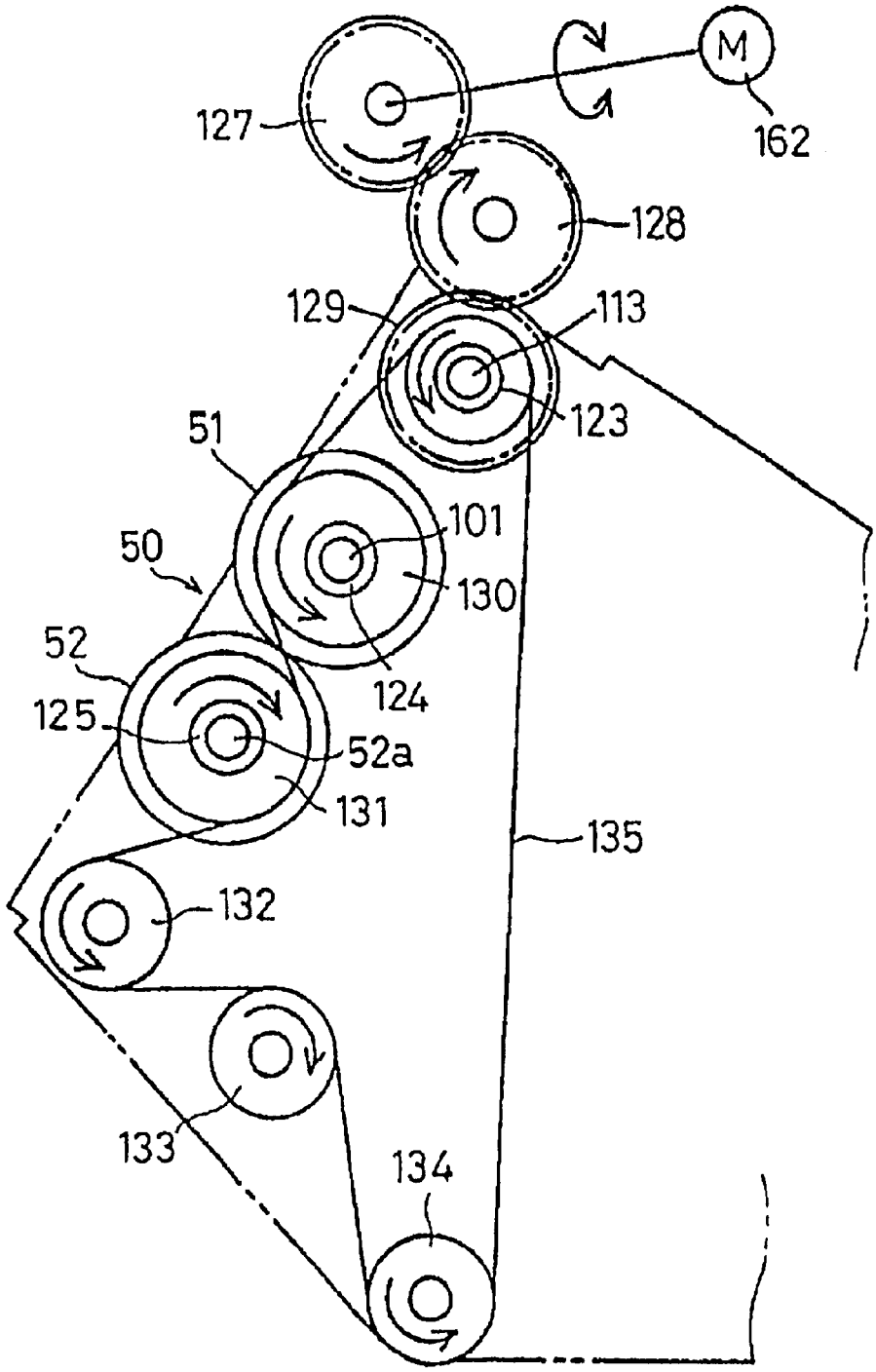
FIG. 19 is the drive transmission system for rotation of the bundle transport rollers of the folding unit.
Figure 20:
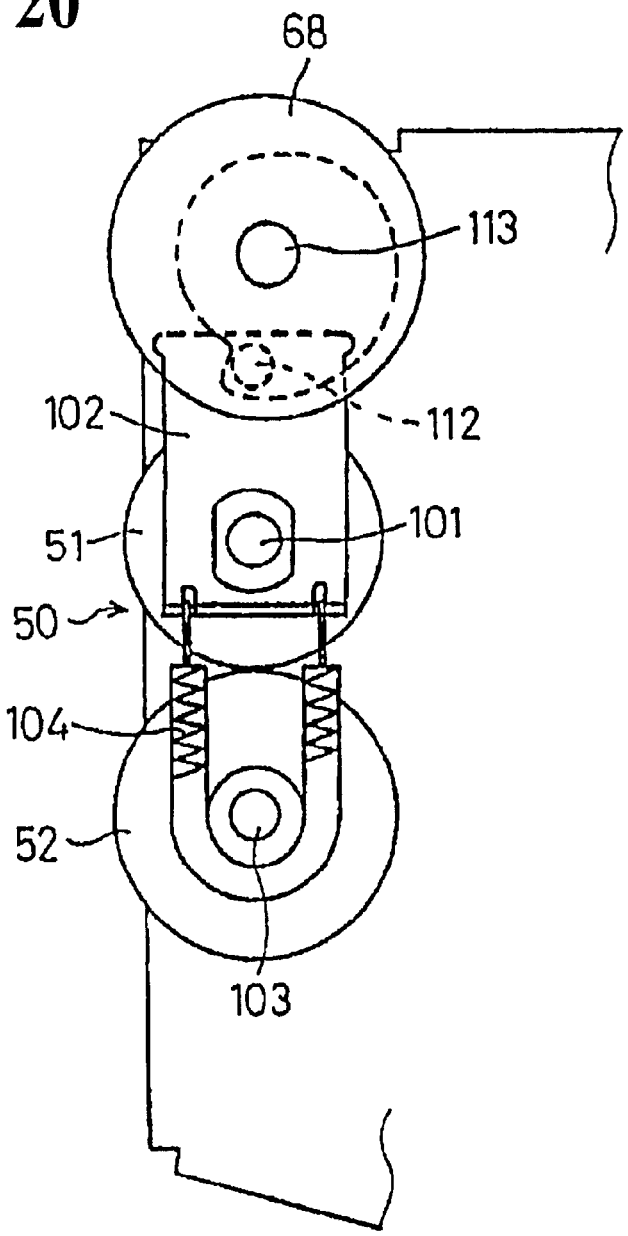
FIG. 20 is the drive transmission system for the separation of the bundle transport rollers of the folding unit.

In turn, the following describes the drive transmission system for the folding unit 50. The drive transmission system for the folding unit 50 is separated into a rotation and adjoining system for the bundle transport upper roller 51 and the bundle transport lower roller 52, as is shown in FIGS. 19 and 20, and into a drive transmission system for the paired folding rollers 57*a* and 57*b* and the abutting plate 55 movement. Those transmission systems are all placed on the back frame of the unit frame 49 shown in FIG. 17.

As shown in FIG. 19 and FIG. 20, the drive system for the bundle transport upper roller 51 and the bundle transport lower roller 52 is input to the gear pulley 129 on the folding unit 50 via the drive gears 127 and 128 from the transport motor 162, which is capable of both forward and reverse drive, mounted on the sheet processing apparatus 2 side.

A one-way clutch 123 is interposed between the gear pulley 129 and a shaft 113 for driving the upper roller moving cam 68. This allows only one-way rotation (reverse direction of the arrow in FIG. 19) of the gear pulley 129 to rotate the upper roller moving cam 68 for a vertical movement of the upper stack carrying roller 51.

Drive force from the gear pulley 129 is transmitted via a timing belt 135 to the upper roller shaft 101 and the lower roller shaft 103 through pulleys 130 and 131. One-way clutches 124 and 125 are interposed between the pulleys 130 and 131, and the upper roller shaft 101 and the lower roller shaft 103 respectively. Driving the pulleys 130 and 131 (in arrow directions in FIG. 19) drivingly rotates the upper roller shaft 101 and the lower roller shaft 103. The timing belt 135 is tightly stretched via idle pulleys 132 and 133 to drive the pair of stack delivery rollers 60*a* and 60*b* to rotate.

If the gear pulley 129 rotates in the direction of the arrow in FIG. 19, the upper stack carrying roller 51 and the lower carrying roller 52 rotate in a direction to transport the sheet bundle into the folding unit 50. When the gear pulley 129 rotates in a reverse direction of the arrow shown, as described above, the upper roller moving cam 68 rotates to make the upper stack carrying roller 51 separate from or press to the lower carrying roller 52. Those actions are controlled with a sensor or the like detecting a flag projection (not sown) placed at the shaft 113.

Figure 21:
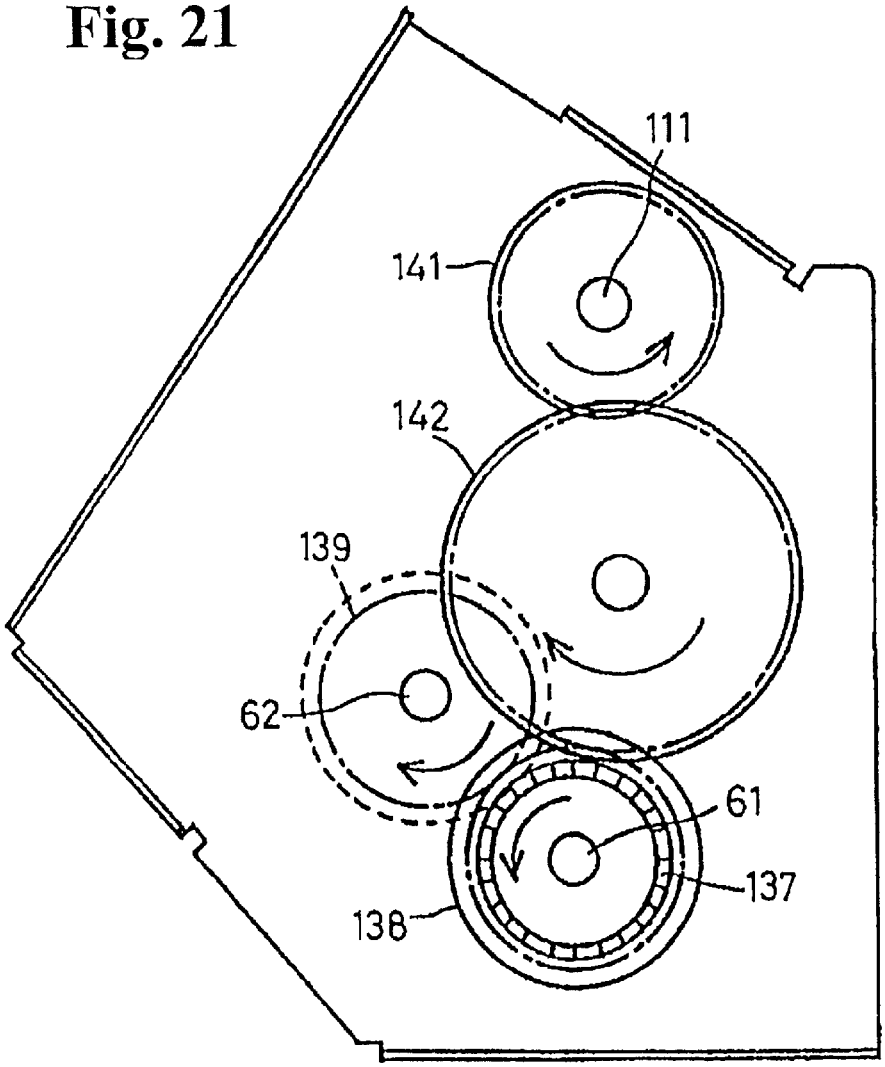
FIG. 21 is the drive transmission system for the paired folding rollers and the abutting plate of the folding unit.

The drive transmission of the paired folding rollers 57*a* and 57*b*, shown in FIG. 21, is mounted to the back of the frame of the drive system shown in FIG. 19 and FIG. 20. In the same drawing, 137 is the coupling device. This coupling device 137 receives the drive from the stapling/folding motor 170 (see FIG. 8) from the side of the sheet processing apparatus 2. Normal rotation (not shown) of the gear 170 drives the coupling device 44 of the stapler unit in FIG. 13, while reverse rotation of the gear 170 rotates the coupling device 137.

The drive from the stapling/folding unit 170 received by the coupling device 137 is transmitted to the gear 139 which rotates one folding roller 57*a* (see FIGS. 18(*a*) and 18(*b*)) by the gear 138 mounted on shaft 61, and is also transmitted to the shaft 111 that drives the cam plate 113 to move the actuating arm 115 there in turn to move the abutting plate 55 via gears 142 and 141. It should be noticed that the position of the cam plate 114 can be seen by detecting a flag projection fixed at the fixed frame 111 with a sensor (not shown).

In turn, the following describes sheet folding operation of the folding unit 50, the structure thereof being explained above. Sheets are carried with the upper stack carrying roller 51 separated from the lower carrying roller 52 to saddle stitching the sheet stack in the processing tray 8 at around a center in a carrying direction thereof. The leading edge of the sheet bundle is then detected and saddle stitching is performed in the middle in the feed direction of the sheet bundle.

The upper roller moving cam 68 (FIG. 17) is then rotated to press the upper stack feed roller 51 against the lower feed roller 52 to drive until the middle of the sheet stack fed in the sheet feed direction comes right below the abutting plate 55. The backup guides 59*a* and 59*b* are then at the positions to cover the outside surfaces of the folding rollers 57*a* and 57*b* and back up, or support a bottom of the sheet stack. The sheet stack therefore can be carried smoothly.

When the approximate middle of the sheet bundle in the carrying direction comes to right below the abutting plate 55, the stack detecting sensor 54 detects the coming and makes the upper stack carrying roller 51 and the lower carrying roller 52 stop from driving once. In such a state, the sheet bundle hangs down by the upper stack carrying roller 51 and the lower carrying roller 52 as shown in FIG. 22(*a*).

This causes the sheet bundle Sa to align itself under its own weight. It is advantageous that with the sheet bundle hung down, there is required a sheet path downstream of the abutting plate 55 without any arrangement like a sheet stopper. It is also advantageous that the folding unit 50 and the whole sheet processing apparatus 2 can be made compact as the downstream from the abutting plate 55 is inclined down.

Figure 22B:
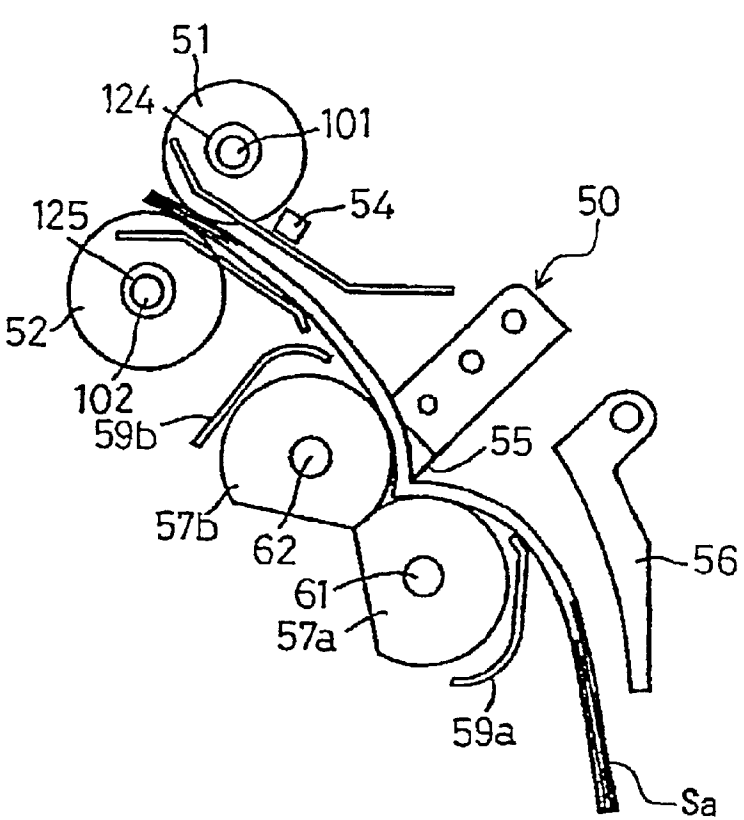
FIGS. 22(*a*) and 22(*b*) are explanatory views of the sheet bundle folding operation of the folding unit.
Figure 22A:
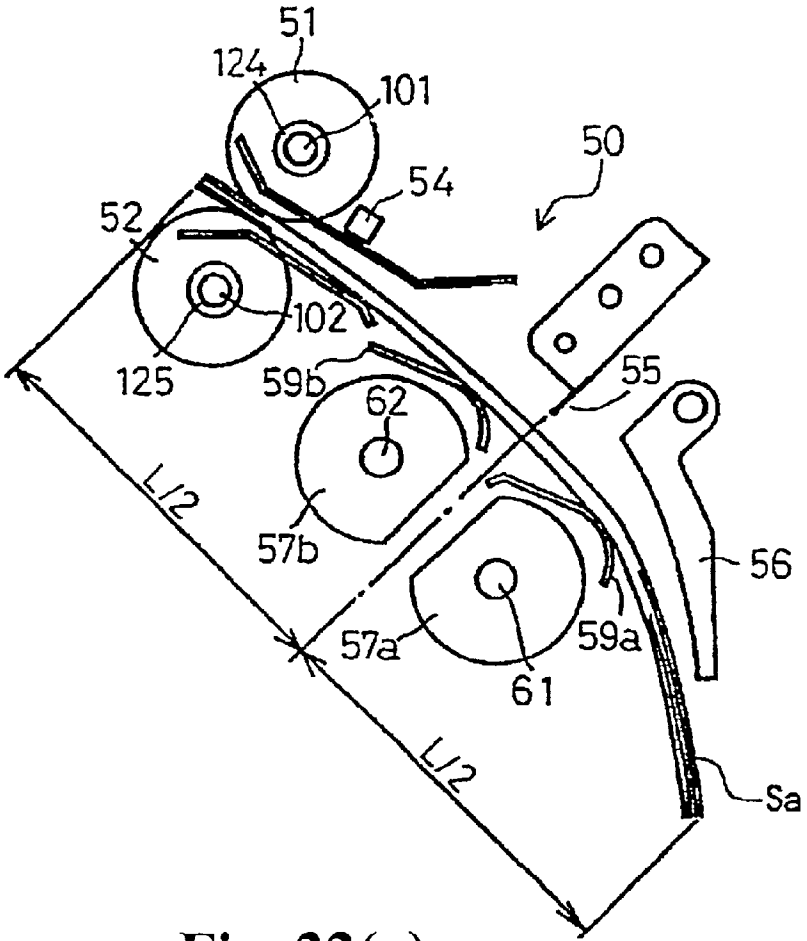

At the stage that the sheet stack comes to the state in FIG. 22(*a*), the folding roller drive shaft 61 then is rotated for driving. This rotates the paired folding rollers 57*a* and 57*b*. The cam plate 114 (FIGS. 18(*a*) and 18(*b*)) also is rotated to move the abutting plate 55 to the nip of the paired folding rollers 57*a* and 57*b*. This results in the paired folding rollers 57*a* and 57*b* rotating while folding the sheet bundle Sa, thereby folding the sheet bundle Sa in the center.

When the abutting plate 55 pushes a half (the middle, L/2) of length (L) of the sheet bundle between the paired folding rollers 57*a* and 57*b*, the upper roller shaft 101 of the upper stack feed roller 51 and the lower roller shaft 103 of the lower feed roller 52 are stopped. However, because the one-way clutches 124 and 125 are interposed between the upper stack feed roller 51 and the shafts 101 and 103, (FIG. 19), the upper stack feed roller 51 and the lower feed roller 52 follow to rotate by being pulled by the sheet bundle, thus not hindering the folding of the sheet bundle, while the sheet bundle is folded by the abutting plate 55.

The sheet bundle, therefore, can be folded smoothly by the paired folding rollers 57*a* and 57*b*. The sheet bundle is then discharged from the folding unit 50 to the sheet bundle stacking tray 80 as the upper stack feed roller 51 and the lower feed roller 52 are rotated to also rotate the paired stack discharge rollers 60*a* and 60*b*.

Figure 23A:
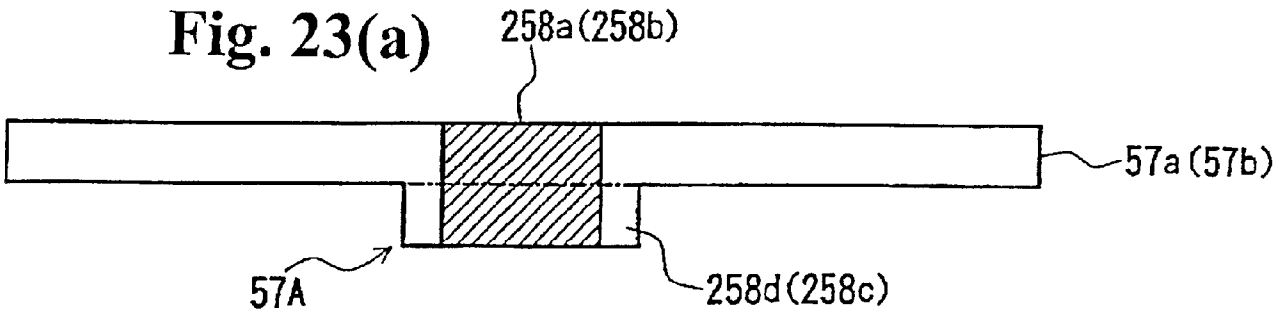
FIGS. 23(*a*) to 23(*c*) show a configuration of the paired folding rollers of the folding unit.
Figure 23B:
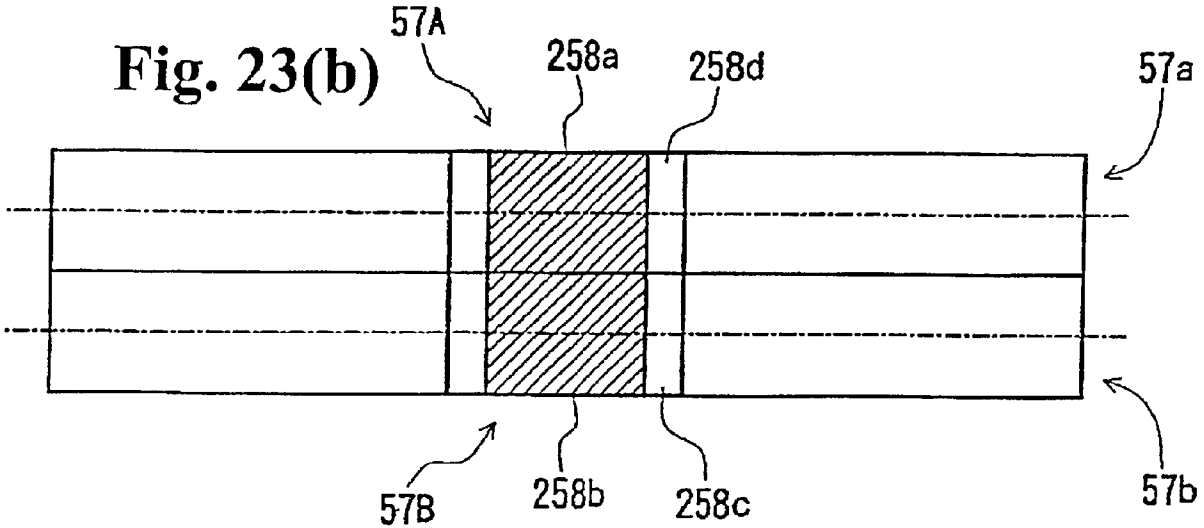
Figure 23C:
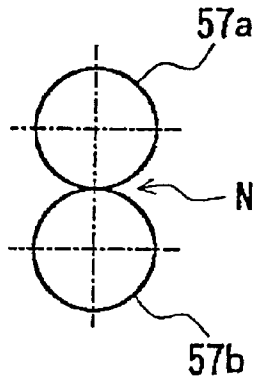

In such an embodiment, the entire surface of the paired folding rollers 57*a* and 57*b* are not composed of a material that has a high coefficient of friction, such as rubber, etc. As can be seen in FIGS. 23(*a*)–23(*c*), the portions 57A and 57B which make contact with the sheets on the paired folding rollers 57*a* and 57*b* have an appropriate area disposed with materials 258*a* and 258*b* that have a high friction coefficient which is limited, say, for example, substantially in the center thereof, while the areas outside of this material of a high friction coefficient 258*a* and 258*b* are formed of a material of a low coefficient of friction 258*c* and 258*d*, such as plastic, etc.

Thus, following the direction of rotation of the paired folding rollers 57*a* and 57*b*, there are the high friction coefficient materials 258*a* and 258*b* and the low friction coefficient materials 258*c* and 258*d* forming the high coefficient of friction region and the low coefficient of friction region around the surface. This reduces the friction coefficient of the surfaces of the portions 57A and 57B that contact the sheets at the high coefficient of paired folding rollers 57*a* and 57*b*.

Figure 24:
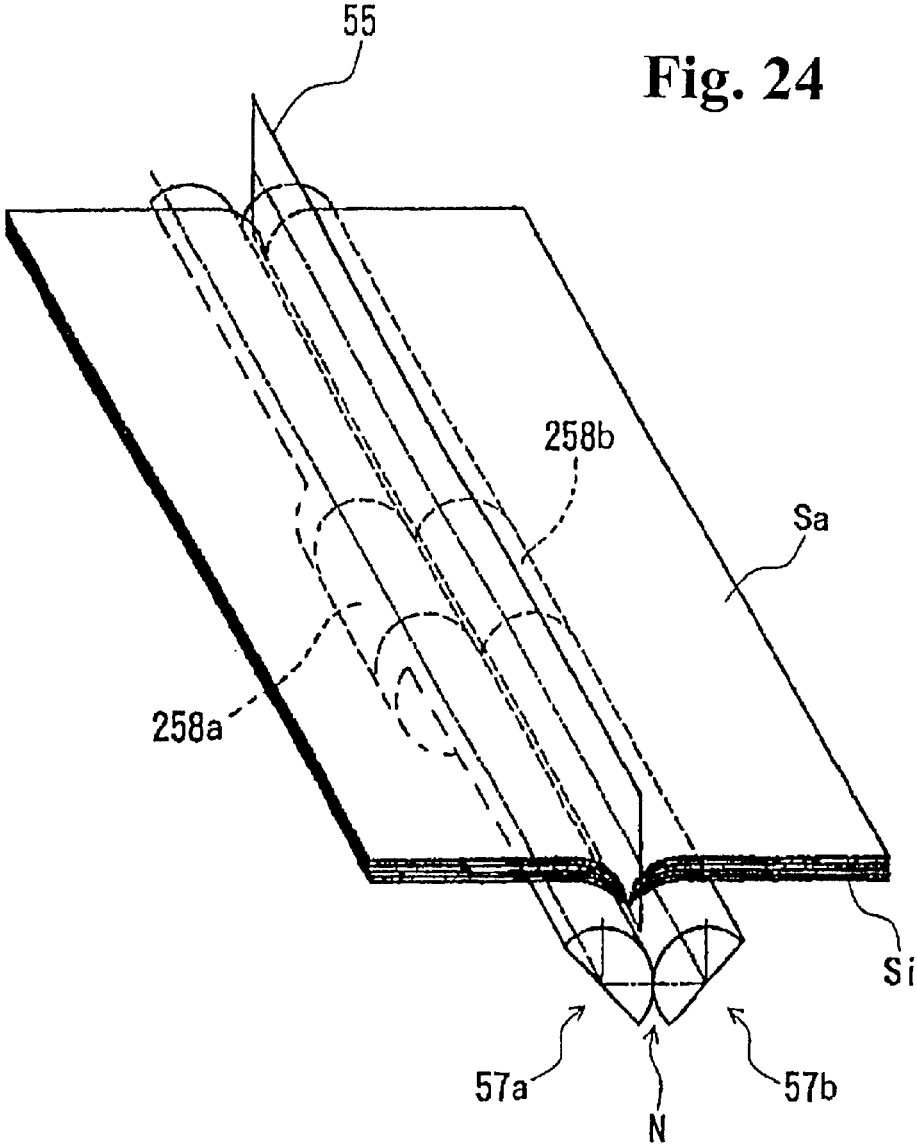
FIG. 24 is a perspective view illustrating the folding operation of the folding unit.

FIG. 24 shows the folding of sheet bundle Sa by this structure of the paired folding rollers 57*a* and 57*b*. When the sheet bundle Sa is being folded, the paired folding rollers 57*a* and 57*b* pull the sheet bundle Sa to be pressed into the nip N of the paired folding rollers 57*a* and 57*b* by the abutting plate 55 to fold the sheet bundle Sa at a determined position.

Figure 25:
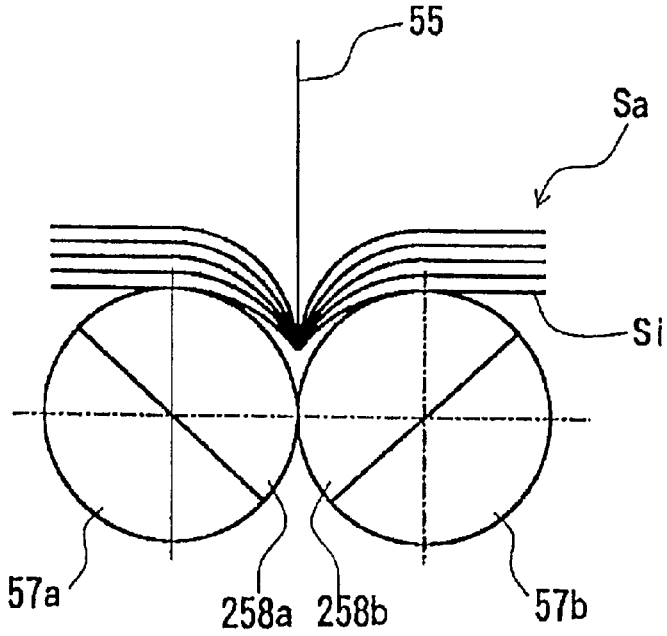
FIG. 25 is a side view illustrating the folding operation of the folding unit.

When pulling the sheet bundle Sa inwardly in this way, there is a low force applied to the sheet Si which is positioned most outside of the sheet bundle Sa directly contacting the paired folding rollers 57*a* and 57*b* because the region for the high coefficient of friction material 258*a* and 258*b* on the paired folding rollers 57*a* and 57*b* is limited. The result is that the sheet Si is not suddenly pulled inwardly between these paired rollers, which means that the adjacent sheets can be folded without forming a gap therebetween, as is shown in FIG. 25.

The pulling force of the paired folding rollers 57*a* and 57*b* to pull the sheet bundle Sa has the strength not to separate the sheet Si which directly contacts the paired folding rollers 57*a* and 57*b* when pulling the sheet bundle Sa from the other sheets. This prevents a powerful and sudden pulling force only on the sheet Si which directly contacts the paired folding rollers 57*a* and 57*b*.

This in turn, then, results in no slowdown of the folding speed, and alleviates the problems of only the sheet in contact with the folding rollers to receive a sudden force and transported therebetween and forming a gap between that sheet and subsequent sheets and causing mis-folds and loosing sheets from the sheet bundle when they are stapled in advance.

Note that, above description relates to forming high friction coefficient regions and low friction coefficient regions on both the paired folding rollers 57*a* and 57*b*, but it is also perfectly acceptable to form both high friction coefficient regions and low friction coefficient regions on only one of the paired folding rollers 57*a* and 57*b*.

Also, it is preferred that the high friction coefficient materials 258*a* and 258*b* on both folding rollers be formed in substantially the same range, as shown in FIGS. 23(*a*)–23(*c*) when the paired folding rollers 57*a* and 57*b* are mounted horizontally with each other. When the paired folding rollers 57*a* and 57*b* are arranged in a vertical positional relationship, the lower folding roller easily contacts the sheet, so that the lower folding roller suddenly transports the sheets.

Figure 26A:
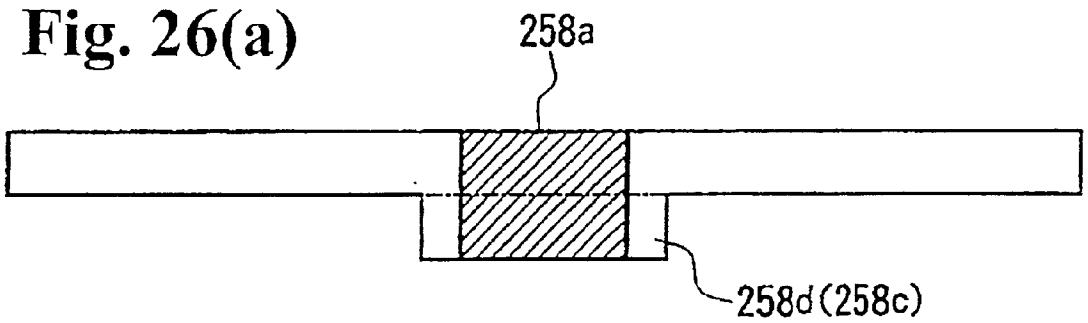
FIGS. 26(*a*) to 26(*c*) show another configuration of the paired folding rollers of the folding unit.
Figure 26B:
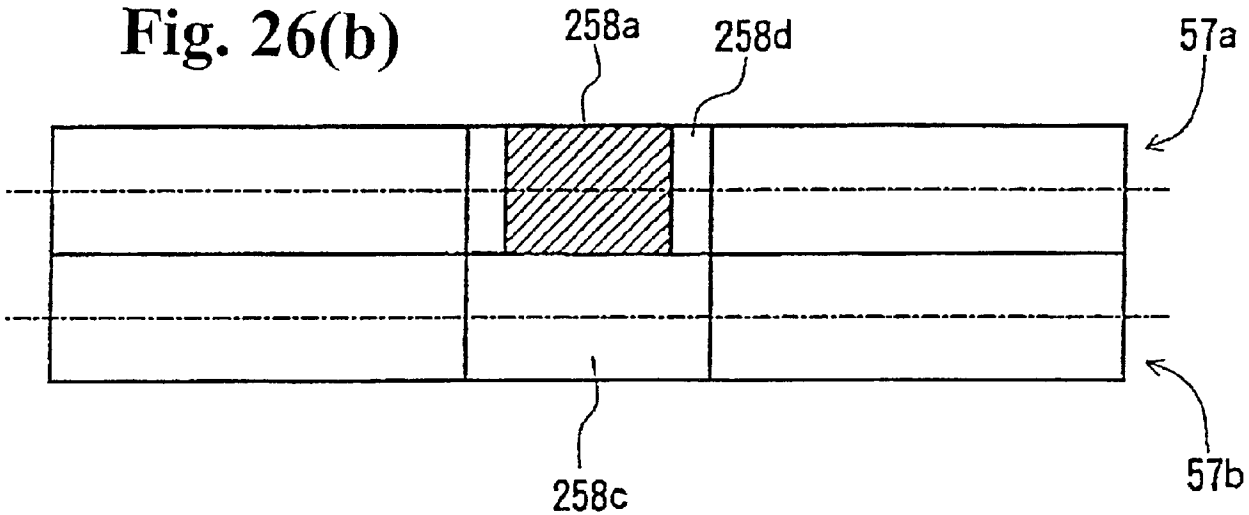
Figure 26C:
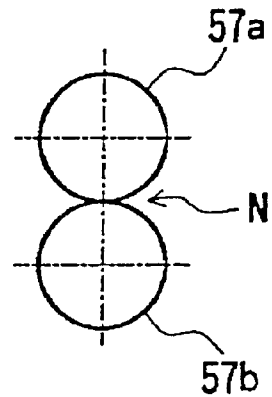

In case the paired folding rollers 57*a* and 57*b* are arranged in a vertical positional relationship, the high coefficient friction material 285*b* is removed from the one folding roller 57*b* that is in a lower position, as shown in FIGS. 26(*a*)–26(*c*). Furthermore, the region of the high friction coefficient material 258*a* on the folding roller 57*a* positioned higher than the other is made narrower than the region of the high friction coefficient material 258*b* on the other folding roller 57*b*. Accordingly, it is possible to make an effective and highly precise transport and folding of sheet bundles between the aforementioned paired folding rollers.

In turn, the following describes the control operation of the sheet processing apparatus 2 with reference to FIG. 8. A control block 149 comprises a central processing unit (CPU), a ROM for storing control means in advance that the CPU executes, and RAM for storing the operational data of the CPU and control data received from the main body 1 of the copier 20. The control block 149 has I/O devices formed therein.

A block for aligning the sheets has a front aligning HP sensor 151 and a rear aligning HP sensor 152 for setting a home position (HP) of the aligning plates 9 that can align both edges of the sheets in the processing tray 8. The aligning plates 9 (FIG. 3) stand by at positions of the front aligning HP sensor 151 and the rear aligning HP sensor 152 until the first sheet is fed into the processing tray 8.

A front aligning motor 14 is a pulse motor for moving the front aligning plate 97 and a rear aligning motor 14 is a pulse motor for moving the rear aligning plate 9. The aligning motors 14 move the respective aligning plates 9 to align the width of the sheet bundle according to the width thereof. The aligning plates 9 can freely deviate each sheet bundle in the width direction.

A circuit for the elevator tray comprises a paper sensor 93 for detecting a top surface of the sheets thereon, an elevation clock sensor 150 for detecting the number of rotations of an elevator tray motor 155 with an encoder, and an upper limit switch 153 and a lower limit switch 154 to limit an elevation range for the elevator tray 90. Signals input from the paper sensor 93 and elevation clock sensor 150 and the upper limit switch 153 and the lower limit switch 154 control the elevator tray motor 155 to drive the elevator tray 90.

A block (relative to the sheet detection) for detecting whether or not a sheet or sheet bundle is stacked on the elevator tray 90 and in the sheet bundle stacking tray 80, is equipped with an elevator tray paper sensor 156 for detecting the presence on the elevator tray 90 and a sheet bundle stacking paper sensor 157 in the sheet bundle stacking tray 80. Those sensors 156 and 157 are also used as sensors for issuing alarms to an operator if any sheet remains before the sheet post-processing apparatus 2 is started or if a sheet bundle is not removed after a predetermined time elapses.

The block relative to a door open-close detection for detecting the opening of a door of the sheet processing apparatus 2 and whether or not the main body 1 of the copier 20 is properly mounted on the sheet processing apparatus 2 has a front door sensor 158 and a joint switch 159 for detecting whether or not the main body 1 of the image forming apparatus 20 has the sheet processing apparatus 2 mounted correctly.

The block (relative to sheet feed and bundle feed) for the sheet feed operation and the sheet bundle feed operation with the stacked sheets comprises a sheet detecting sensor 4 for detecting on the feed guide 3 that a sheet is fed from the main body 1 of the copier 20 to the sheet post-processing apparatus 2, a processing tray sheet detecting sensor 160 for detecting the presence of a sheet on the processing tray 8, a center stitching position sensor 95, a center stitching and folding position sensor 95' for detecting the leading edge of the sheet bundle in the feed direction to deduce the same position for folding the sheets as the staple driven position, a pushing pawl sensor 76 for detecting a home position of the pushing pawl 13 established on the feed belt 12 for transferring the sheet bundle on the processing tray 8 toward the elevator tray 90, and an upper stack feed roller HP sensor 161 for detecting the home position at which the upper stack feed roller 51 at an inlet of the folding unit 50 is separated away from the lower bundle feed roller 52. The circuit can control the feed motor 162 and the stepping motor 70 according to signals from the respective sensors.

The rotating force of the feed motor 162 is transmitted to the paired feed rollers 5, the paired discharge rollers 6, the upper stack feed roller 51, the lower bundle feed roller 52, and the paired stack discharge rollers 60*a* and 60*b*. The reverse rotation of the feed motor 162 turns the upper roller moving cam 68 to move the paired stack feed rollers 51. The rotating force of the stepping motor 70 is transmitted to the lower bundle feed roller 18 and the upper feed roller 19 formed on the processing tray 8 and the first pulley 10 to circulate the feed belt 12.

The block (relative to paddle) for controlling the paddle 17 comprises a paddle HP sensor 163 to detect the rotating position of the paddle 17 and an upper feed HP sensor 164 to detect the position where the upper feed roller 19 separates from the lower bundle feed roller 18, thereby controlling the paddle motor 165 according to signals from the sensors 163 and 164.

The block (relative to staple/folding) for controlling the staple/folding operation is comprised of a staple HP sensor 166 to detect that the staple driving head unit 31 and the anvil unit 32 in the saddle stitching unit 30 can drive staples, a staple sensor 167 to detect whether or not the staple driving head unit 31 has staples set therein, a staple slide HP sensor 168 to detect whether or not the sheet bundle is at a home position (FIG. 13) when start-moving in the sheet feed direction between the both units 31 and 32, a staple/folding clock sensor 171 to detect the rotation direction of the staple/folding motor 170 that can switch the drive of the saddle stitching unit 30 and the folding unit 50 to normal or reverse, and a safety switch 172 for detecting that the saddle stitching unit 30 and the folding unit 50 are operable. The circuit having the sensors and switches mentioned above controls the stapler slide motor 42 and the staple/folding motor 170.

The stapler slide motor 42 transmits the rotating force to the screw shaft 36 to move the staple driving head unit 31 and the anvil unit 32 in the width direction thereof. A gear 170 is arranged to drive the coupling device 44 (FIG. 14) for the saddle stitching unit 30 in one of the normal or reverse rotation direction or the coupling device 137 (FIG. 6) for the folding unit 50 in the other rotation direction.

Next, the following describes operations in the process modes of the sheet processing apparatus 2. This embodiment of the sheet processing apparatus 2 provides the following basic modes.

(1) Non-staple mode: A mode for stacking the sheets onto the elevator tray 90 without stitching;

(2) Side staple mode: A mode for saddle stitching the sheets at one or a plurality of positions on an edge (side) thereof in the sheet feed direction before loading the sheets onto the elevation tray 90;

(3) Saddle staple mode: A mode for stitching the sheets at a plurality of positions on a half length of the sheets in the sheet feed direction and for folding and binding the sheets at the stitched positions before stacking the sheets onto the sheet bundle stacking tray 80.

At first, non-staple mode is explained. With this mode of process selected, the control block 149 drives the stepping motor 70 for rotating the transfer belt 12 to move the pushing pawl 13 at the home position (HP in FIG. 12) to the pre-home position (Pre-HP in FIG. 12) that is a sheet loading reference position on the processing tray 8 before stopping.

At the same time, the control block 149 drives the carrying motor 162 to rotate the pair of carrying rollers 5 and the pair of delivery rollers 6 and waits for a sheet to be delivered from the delivery rollers 1*a* and 1*b* of the main body 1 of the duplicating machine 20. After that, when the sheet is discharged, the paired feed rollers 5 and the paired discharge rollers 6 feed the sheet to the processing tray 8. Then, when the sheet detecting sensor 4 detects the sheet, start timings of the aligning motors 14 for the aligning plates 9 and the paddle motor 165 for rotating the paddle 17 are measured.

The control block 149 drives the aligning motors 14 and the paddle motor 165 while the sheet is discharged and stacked onto the processing tray 8. With the drive, the aligning plates 9 move in the width direction traversing the sheet feed direction to align the both edges of the sheet, and the paddle 17 is rotated to make one side of the edges of the sheets strike the pushing pawl 13 at the Pre-HP position to align the sheets. This operation is repeated whenever the sheet is discharged to the processing tray 8.

After that, if a predetermined number of sheets is aligned to the pushing pawl 13, the control block 149 stops the feed motor 162 and the paddle motor 165 from rotating, and also restarts the stepping motor 70 for driving the feed belt 12. With this operation, the sheet bundle is moved to the elevator tray 90 (the arrow A direction in FIG. 3) before being loaded on the elevator tray 90.

Along with the delivery of the sheet bundle, the control block 149 makes the elevator tray motor 155 move down to a certain distance in a downward direction of the elevator tray 90 once. Subsequently, it drives the elevator tray motor 155 upward until the paper sensor 93 detects the top sheet before stopping, and makes the elevator tray motor 155 idle until the following sheet bundle is loaded thereupon.

In turn, the side staple mode is described below. When the side staple mode is selected, the control block 149 drives the feed motor 162 to rotate the paired feed rollers 5 and the paired discharge rollers 6 to deliver a sheet from the main body 1 of the copier 20 to the processing tray 8 to stack. The control block 149 also drives the aligning motors 14 and the paddle motor 165 while the sheet is discharged and stacked. With this operation, the sheet is aligned on both edges in the width direction thereof by the aligning plates 9, and the leading edge of the sheet is transferred to the stopper 21 to stop. This operation is repeated for a specified number of sheets.

In the state where the sheet bundle is restricted by the stopper 21, the upper feed roller 19 is moved to the lower bundle feed roller 18 to make the upper feed roller 19 and the lower bundle feed roller 18 nip the sheet bundle. At that time, the staple driving head unit 31 and the anvil unit 32 are both positioned at the staple home position shown in FIG. 13.

The staple home position is a position where one stitching is made on the left unit frame 41 side shown in FIG. 13, that is, on the back side of the duplicating machine 20 and the sheet post-processing apparatus 2 shown in FIG. 1. Positioning the both units 31 and 32 for the staple home position is made by moving the both units 31 and 32 for a distance of a specific number of pulses from the HP sensor (not shown) disposed on the left unit frame 41 side shown in FIG. 13.

If the one-position stitching is specified, for example, the control block 149 makes the staple/folding motor 170 to be driven to rotate in the staple moving direction to make the both units 31 and 32 proceed with stitching. To stitch the sheets at a plurality of positions on the edge thereof, the stapler slide motor 42 should be driven to move the both units 31 and 32 from the staple home position to a desired staple position before proceeding with stitching.

After the stitching process is finished, the lower feed roller 18 and the upper feed roller 19 are rotated, and the transfer belt 12 is moved toward the elevation tray 90 side (arrow A direction in FIG. 3) by the stepping motor 70. This delivers the sheet bundle to the lower bundle feed roller 18, the upper feed roller 19, and pushing pawl 13 in this order before loading the sheet bundle onto the elevator tray 90. The operation of the elevator tray 90 is the same as in the nonstaple mode described above, so that an explanation shall be omitted.

In turn, the saddle staple mode is described below. Because the stacking of the sheets discharged from the copier 1 onto the processing tray 8 is similar to that of the side staple mode of operation described above, a description shall be omitted.

After the sheets are aligned and loaded on the processing tray 8, the upper carrying roller 19 is moved down to the lower carrying roller 18 side to make the upper carrying roller 19 and the lower carrying roller 18 nip the sheet stack. In turn, the stopper 21 is retracted away from the feed path 25 before the control block 149 drives the stapler slide motor 42 to transfer the sheet bundle in the arrow B direction in FIG. 3.

The drive allows the stopper engaging projection 24 on the staple driving head unit 31 also to move as shown in FIG. 13 to engage the moving arm 23. This retracts the stopper 21 from an area where the staple driving head unit 31 and the anvil unit 32 move, as shown in FIG. 16.

It should be noticed that the stopper 21 may be alternatively replaced by a single wide stopper plate 421 (FIG. 4) or a plurality of stopper plates 221 (FIG. 5) extending in the direction in which the staple driving head unit 31 moves along the guide rod 34, the direction being a direction orthogonal to the direction in which the sheets are delivered from the duplicating machine 20 to the sheet post-processing apparatus 2 or a direction orthogonal to the direction in which the sheet bundle is fed in the sheet bundle feed path.

By the engagement of the stopper engaging projection 24 of the staple driving head unit 31 with the moving arm 23, all the stopper plates are moved away from the moving area of the staple driving head unit 31 and the anvil unit 32 to make the sheet bundle feed path free.

In this embodiment, the stopper engaging projection 24 is disposed in the staple driving head unit 31. Alternatively, the stopper engaging projection 24 can be placed in the anvil unit 32 so as to retract the stopper away from the moving area of the staple driving head unit 31 and the anvil unit 32 along with movement of the anvil unit 32 to make the sheet bundle feed path free.

In such a construction, the staple driving head unit 31 and the anvil unit 32 move from the home staple position shown in FIG. 13 along the guide rods 33 and 34 to open the sheet bundle feed path 25 free before stopping at the driving set positions in the width direction. The stopping positions of the both units 31 and 32, however, can be specifically controlled to change depending on the difference of the alignment reference by the aligning plate 9 and difference of the sheet size as will be described later.

Further, the control block 149 rotates the stepping motor 70 in a direction reverse to the non-staple and side staple modes in the process. This drive makes the sheet bundle feed in the direction reverse (the direction of the arrow B in FIGS. 2 and 3) to the elevator tray 90. If, in the transfer, the stack detecting sensor 54 in the folding unit 50 detects a leading end of the sheet stack in the carrying direction (sheet size data), the upper carrying roller 19 and the lower carrying roller 18 carry and stop the sheet stack to a position at which the approximate middle position in the sheet carrying direction coincides with the stitching position according to the sheet length information in the carrying direction sent in advance.

It should be noticed that if the stepping motor 70 rotates in the reverse direction, the one-way clutch 75 interposed between the first pulley 10 and the first pulley shaft 10*a* for tightly stretching the transfer belt 12 prevents the rotating force of the stepping motor 70 from transmitting but keeps the transfer belt 12 and the pushing pawl 13 stopped at the home position.

Next, the control block 149 rotates the staple/folding motor 170 for driving the drive shaft 38 and the anvil drive shaft 37 to rotate in the directions for operation thereof to stitch. When there requires a plurality of stitchings at a plurality of positions, the stapler slide motor 42 is driven to rotate the screw shafts 35 and 36 to move to the specific positions in the width direction before stitching.

After saddle stitching the sheet bundle at a single position or a plurality of positions, the both units 31 and 32 are moved from the final stitching position to the home staple position shown in FIG. 13 along the guide rods 33 and 34. This disengages the stopper engaging projection 24 of the staple driving head unit 31 from the moving arm 23. As a result, the stopper 21 (stopper plate 421 or 221) returns to the moving area of the both units 31 and 32, closes the feed path 25, and prepares for the alignment of the leading edge of the next sheets.

Accordingly, in a stroke of the both units 31 and 32 moving from the staple home position to the staple position and returning again to the staple home position, the position for retracting the stopper 21, the position for stitching process, and the position for returning the stopper in the sheet bundle feed path 25 are already set. In the stroke, there is also set the position for a preguide 370 (which will be described later) to guide the sheet bundle.

Figure 27:
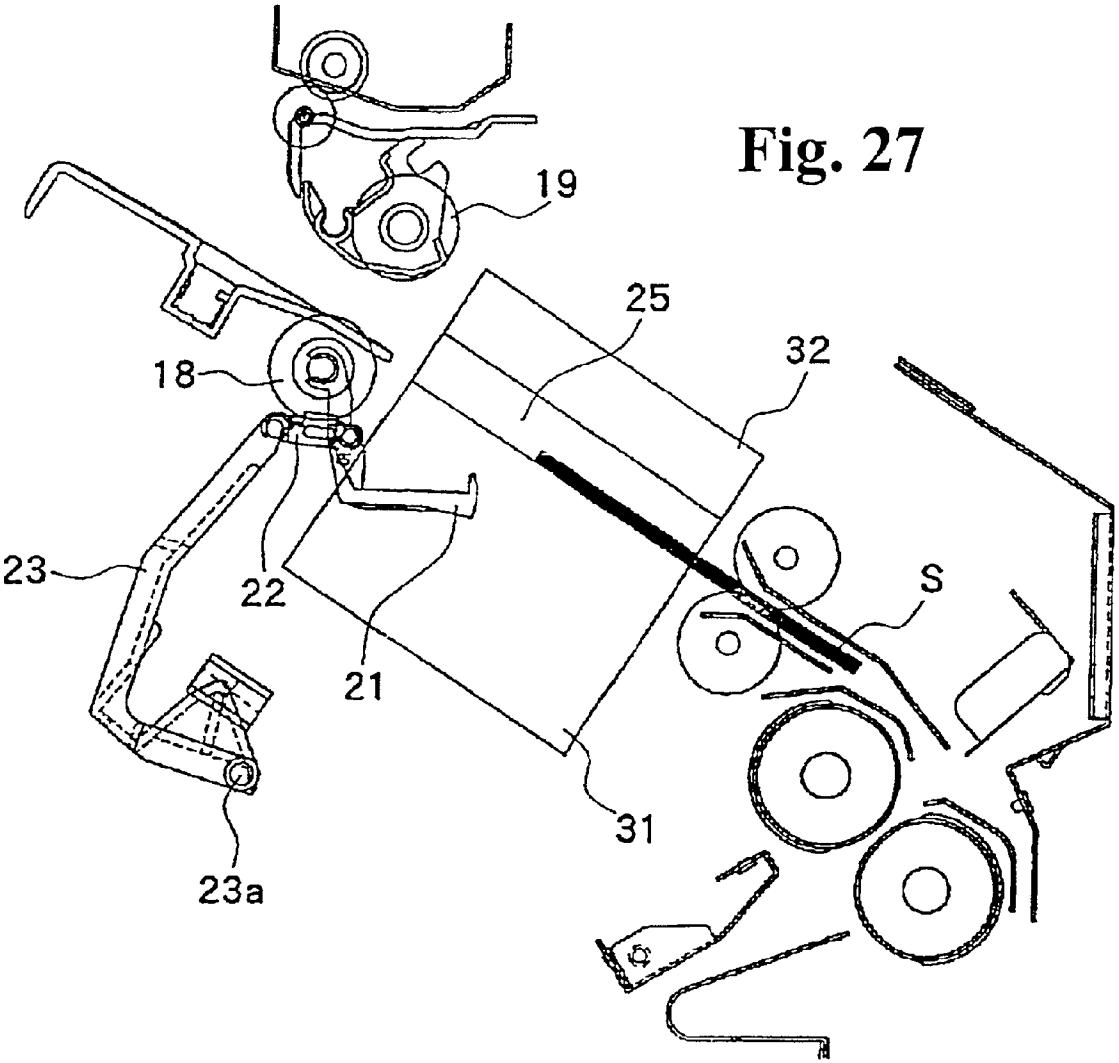
FIG. 27 shows a positional relationship for the sheet bundle when the stopper is returned to a limiting position.

It should be noticed that timing when the both units 31 and 32 move from the position for stitching the final sheet bundle to the position for allowing the stopper 21 to return to the feed path 25 do not need to wait until the sheet bundle having the finished stitching is entirely delivered from the sheet post-processing apparatus 2. If a trailing edge of the sheet bundle S in the feed direction has passed over the stopper 21 as shown in FIG. 27, for example, the stopper 21 can be moved to the position for returning into the feed path 25.

Therefore, alternatively, the both units 31 and 32 may start to move at an instance when the both units 31 and 32 reach a position to which the stopper 21 is returned after the trailing edge of the sheet bundle has passed over the stopper 21 with reference to the size of the sheet, a sheet bundle feed speed, and other factors. Such a scheme can make it fast to make ready for accepting a next sheet stack.

Figure 28:
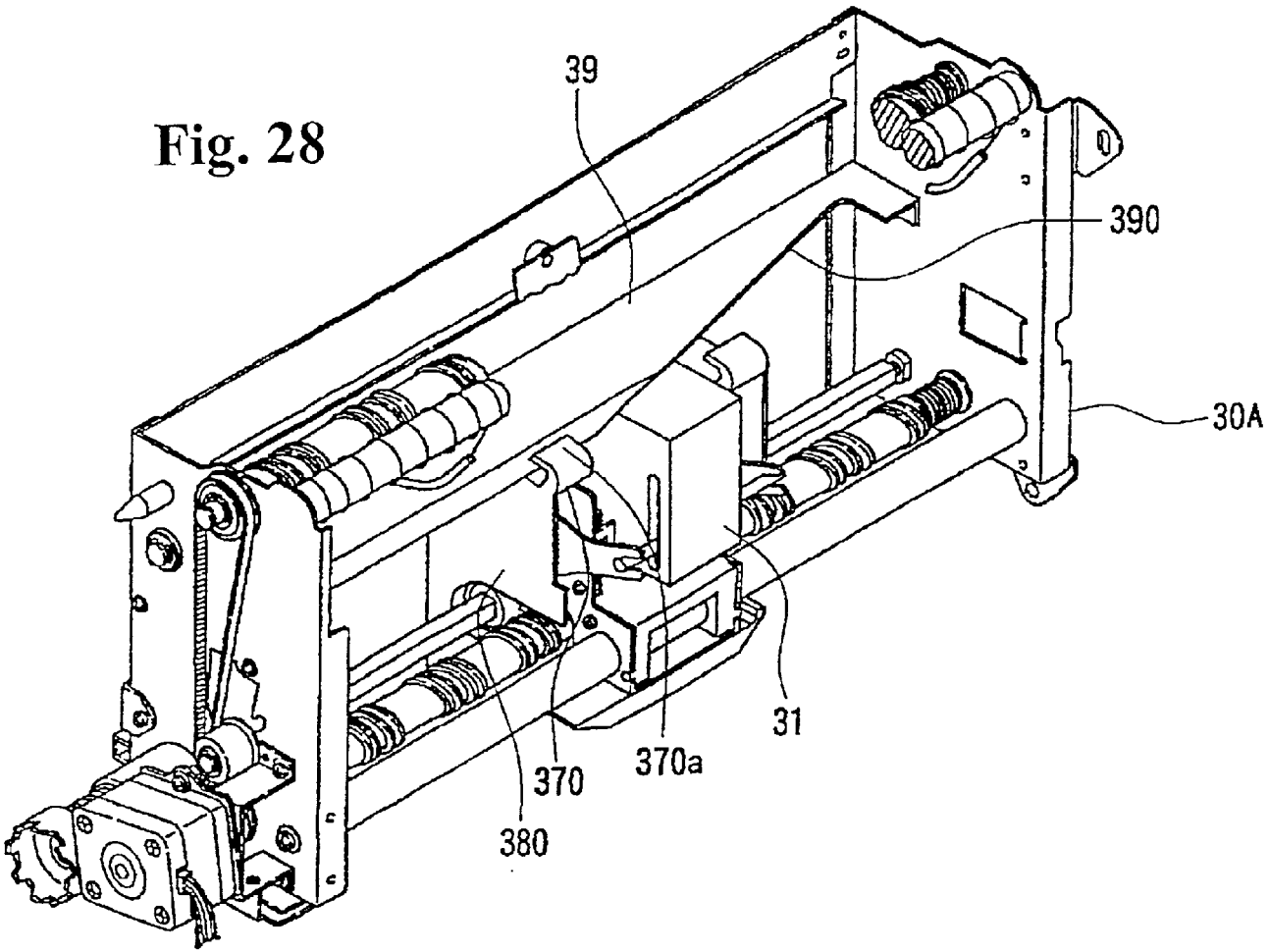
FIG. 28 is a perspective view for showing a positional relationship between a feed guide and a preguide disposed in the saddle stitching unit.

The leading edge of the sheet bundle may be caught at an upstream edge of the feed guide disposed in a lower casing 30A having the staple driving head unit 31 of the saddle stitching unit 30 shown in FIG. 28 attached thereto when the sheet bundle passes over the stopper 21 moved to the retracted position to the stitching position. This causes the sheet bundle to be deformed in posture and the sheets to be stacked, resulting in incorrect saddle stitching.

Figure 29:
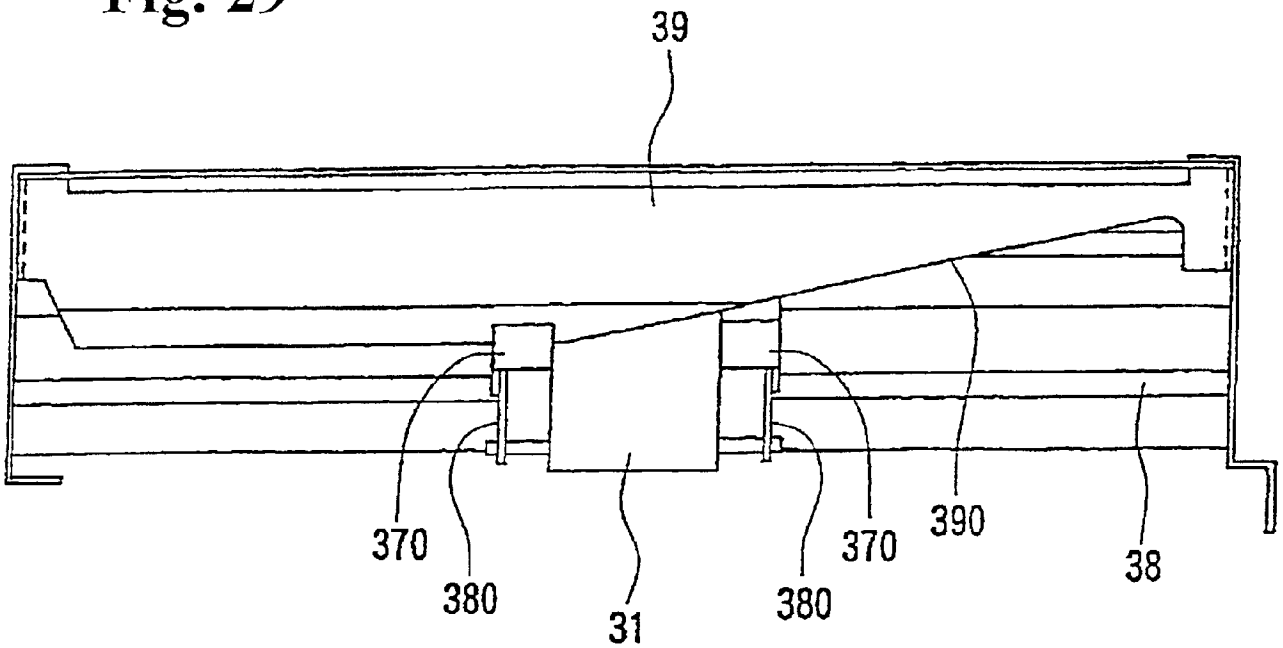
FIG. 29 is a top view for showing a positional relationship between the feed guide and the preguide.
Figure 30:
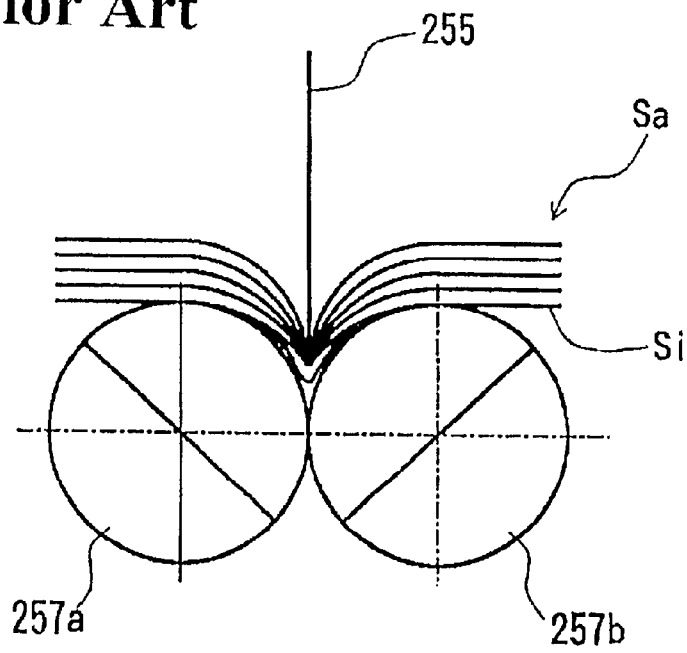
Fig. 30 Prior Art
FIG. 30 shows a problem with a conventional sheet processing apparatus.

To prevent such a failure, in the embodiment, the staple driving head unit 31 positioned at the upstream of the feed guide 39, as shown in FIGS. 28 and 29, has a cover 380 disposed fixedly on both ends thereof. Further, the cover 380 has a preguide 370 disposed on a top thereof. The preguide 370 can guide the sheet bundle to the feed guide 39 without allowing the leading edge thereof to touch the upstream edge of the feed guide 39 when the sheet bundle is fed to the stitching position.

The preguide 370, as shown in FIG. 28, is disposed to project higher than the feed guide 39 to prevent the leading edge of the sheet bundle from being caught by the upstream of the feed guide 39. Also, the preguide 370 has a slope 370*a* provided for guiding the sheet bundle above the feed guide in the projection direction to prevent the leading edge of the sheet bundle from touching the upstream edge of the feed guide 39 after the preguide 370 abuts against the sheet bundle.

Further, the downstream edge of the preguide 370 in the sheet bundle feed direction, as shown in FIGS. 28 and 29, is positioned more downstream in the sheet bundle feed direction than the upstream edge of the feed guide 39. With the downstream edge of the preguide 370 and the upstream edge of the feed guide 39 overlapping each other, leading edge of the sheet bundle is prevented from entering between the preguide 370 and the feed guide 39.

As the preguide 370 is fixed at the both edges of the staple driving head unit 31, if the sheet bundle aligned by the aligning plates 9 with reference to a center in the width direction is fed to the feed guide 39, the sheet bundle is moved to a center in the width direction common to the sheets or to a position close to the center, for example, to a stitching position together with the staple driving head unit 31. This allows the sheet bundle to be guided to the feed guide 39 with good balance.

In case, the sheet bundle, which is aligned on the base of either side of the edges in the width direction by the aligning plate 9, is transferred to the feed guide 39, the center of the sheet changes depending of the sheet size. However, the control block 149 as control means can control the stapler slide motor 42 on the basis of at least one of the aligning reference and the sheet size data, so that the preguide 370 is moved to the center position in the width direction or to the position close thereto depending on size of the sheet together with the staple driving head unit 31. With such a control, the sheet bundle can be guided into the feed guide 39 in good balance.

With such means, the sheet bundle led to the feed guide 39 by the preguide 370 can be firmly supported and guided in the width direction by the feed guide 39. The sheet bundle can be saddle stitched by the staple driving head unit 31 and the anvil unit 32. This makes the saddle stitching surely on the sheet bundle correctly.

In the embodiment, the preguide 370 is fixed to the staple driving head unit 31 and is movable together with the staple driving head unit 31. Alternatively, the preguide 370 itself may be moved independently.

In the embodiment, the preguide 370 is disposed on the staple driving head unit 31 side viewed from the sheet bundle since a leading edge of the sheet bundle curled on the side of the staple driving head unit 31 arranged on a printing side of the sheets tends to be caught by the upstream edge of the feed guide 39 as curling occurs usually on the leading edge of the sheets.

Alternatively, the feed guide may be attached to the anvil unit 32. If the feed guide is attached to the anvil unit 32, the preguide 370 may be placed on the side of the anvil unit 32 as viewed from the sheet bundle, for example, may be disposed on an additional side cover (not shown) fixed to the anvil unit 32.

It should be noted that the feed guide 39 has a cutout portion 390 provided to be slanted on the upstream edge thereof from the center portion toward the edge in the sheet feed direction as shown in FIGS. 28 and 29. With the slanted cutout portion 390 disposed, the edges of the sheet bundle can be smoothly guided to a guide surface on the feed guide 39 depending on feeding of the sheet bundle.

When the sheet bundle has been fed to the stitching position, on the other hand, the leading edge of the sheet bundle in the feed direction is already at a position having passed over an area between the lower bundle feed roller 52 in the folding unit 50 and the upper stack feed roller 51 separated from the lower bundle feed roller 52.

After the stitching is completed, the sheet bundle is fed to come to an approximate center in the feed direction, that is, to bring the stitched position to become the folding position. The staple/folding motor 170 then is driven in a reverse direction of the stitching process. The pair of folding rollers 57*a* and 57*b* is rotated in the directions of nipping the sheet bundle S, and the abutting plate 55 is moved down as shown in FIGS. 22(*a*) and 22(*b*). At the same time, the backup guides 59*a* and 59*b* move to free the circumferences of the paired folding rollers at the sheet bundle side.

After the abutting plate 55 has moved the rotating paired folding rollers 57*a* and 57*b* having the sheet bundle nipped therebetween, the sheet bundle S is rolled in between the paired folding rollers 57*a* and 57*b*. After that, while the abutting plate 55 moves in the direction separating from the sheet bundle, the sheet bundle is further folded by the paired folding rollers 57*a* and 57*b*.

At this point, the bundle feed upper roller 51, bundle feed lower roller 52 and the paired bundle feed rollers 60*a* and 60*b* are rotated in the direction to discharge the sheet bundle to the stack loading tray by the feed motor 162. The paired folding rollers 57*a* and 57*b*, on the other hand, are stopped when the abutting plate 55 moves up and is detected by the abutting plate HP sensor (not shown).

The sheet bundle S nipped and fed by the paired stack discharge rollers 60*a* and 60*b* is discharged to and stacked on the sheet bundle stacking tray 80. The folded sheet bundle is held down by the folded sheet holder 81 so that it does not open, thereby not preventing a subsequent folded sheet bundle from being fed in.

It should be noted that the upper stack feed roller 51 separates from the lower bundle feed roller 52, moves up, and prepares to feed in the next sheet bundle when a period of time available for the paired stack discharge rollers 60*a* and 60*b* to deliver the sheet bundle has elapsed.

In the saddle stitch mode in the embodiment described above, the stitching process and the folding process are consecutive. It should be noted that only the folding process can be performed without the stitching process. Furthermore, the folded sheet bundle device can receive thereon only the sheet bundles folded but not stitched.

Thus, as described in the preferred embodiments according to this invention, the pulling force of the paired rotating bodies has an amount that does not cause the sheet that contacts the paired rotating members to separate from the other sheets when the sheet bundle is pulled therein, so that there is no forceful or sudden pulling on only the sheet directly contacting the aforementioned paired rotating members without a slowdown in the folding speed to enable a proper folding of the sheet bundle.

While the invention has been explained with reference to the specific embodiments of the invention, the explanation is illustrative, and the invention is limited only by the appended claims.

What is claimed is:

1. A sheet processing apparatus for folding a sheet bundle at a predetermined position, comprising:

pressing means for pressing a predetermined position of said sheet bundle to fold the sheet bundle; and paired rotating bodies for folding the sheet bundle supplied by the pressing means, said paired rotating bodies having nip portions contacting the sheet bundle, said nip portions having a high friction coefficient region and a low friction coefficient region less than the high friction coefficient region in friction coefficient, which are made of different materials, each of said paired rotating bodies being formed of one roller having a circular portion forming the nip portion and two non-circular portions, said circular portion having said high and low friction coefficient portions and being located between the two non-circular portions in one roller, said high friction coefficient portion being sandwiched between two low friction coefficient portions in one circular portion so that a pulling force of the rotating bodies to pull the sheet bundle pressed into the nip portions of the rotating bodies by the pressing means has an amount which does not separate a sheet of said sheet bundle contacting the rotating bodies from subsequent sheets in the sheet bundle when pulling the sheet bundle.

2. A sheet processing apparatus according to claim 1, wherein said high friction coefficient region on said one rotating body is narrower than the high friction coefficient region on said other rotating body.

3. A sheet processing apparatus according to claim 2, wherein one of said rotating bodies is positioned lower than the other of said rotating bodies of said paired rotating bodies.

4. An image forming apparatus comprising: an image forming unit and said sheet processing apparatus according to claim 1 disposed in the image forming unit, said sheet processing apparatus folding at a predetermined position a sheet bundle formed with images thereupon by said image forming unit.

5. A sheet processing apparatus for folding a sheet bundle at a predetermined position, comprising:

pressing means for pressing a predetermined position of said sheet bundle to fold the sheet bundle; and paired rotating bodies for folding the sheet bundle supplied by the pressing means, said paired rotating bodies having nip portions contacting the sheet bundle, one of said nip portions having a high friction coefficient region and a low friction coefficient region less than the high friction coefficient region in friction coefficient, which are made of different materials, each of said paired rotating bodies being formed of one roller having a circular portion and non-circular portions, said circular portion in one of said paired rotating bodies having said high and low friction coefficient portions and said circular portion in the other of said paired rotating bodies having only said low friction coefficient portion so that a pulling force of the rotating bodies to pull the sheet bundle pressed into the nip portions of the rotating bodies by the pressing means has an amount which does not separate a sheet of said sheet bundle contacting the rotating bodies from subsequent sheets in the sheet bundle when pulling the sheet bundle.

* * * * *